US009061690B2

(12) United States Patent
Kanemori et al.

(10) Patent No.: US 9,061,690 B2
(45) Date of Patent: Jun. 23, 2015

(54) GUIDE RAIL TYPE VEHICLE

(75) Inventors: Toru Kanemori, Tokyo (JP); Hiromichi Yamamoto, Tokyo (JP); Kousuke Katahira, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 215 days.

(21) Appl. No.: 13/814,280

(22) PCT Filed: Jul. 25, 2011

(86) PCT No.: PCT/JP2011/066834

§ 371 (c)(1),
(2), (4) Date: Feb. 5, 2013

(87) PCT Pub. No.: WO2012/086251

PCT Pub. Date: Jun. 28, 2012

(65) Prior Publication Data

US 2013/0133546 A1 May 30, 2013

(30) Foreign Application Priority Data

Dec. 20, 2010 (JP) ..... 2010-283192

(51) Int. Cl.
*B61F 5/38* (2006.01)
*B61B 10/04* (2006.01)
*B61B 13/00* (2006.01)

(52) U.S. Cl.
CPC . *B61F 5/38* (2013.01); *B61B 10/04* (2013.01); *B61B 13/00* (2013.01)

(58) Field of Classification Search
CPC ..... B61B 13/04; B61B 10/001; B61B 10/04; B61B 13/00; B62D 1/265; B62D 1/26; B61F 9/00; B61F 5/38; E01B 25/28
USPC ..... 104/247, 245; 105/215.2, 215.1, 72.2
See application file for complete search history.

(56) References Cited

U.S. PATENT DOCUMENTS 3,077,165 A * 2/1963 Vittorelli ..... 104/247
3,921,532 A 11/1975 Nelson (Continued)

FOREIGN PATENT DOCUMENTS

CN 2328557 7/1999
DE 1 004 216 3/1957

(Continued)

OTHER PUBLICATIONS

Chinese Office Action issued Sep. 19, 2014 in corresponding Chinese Patent Application No. 201180038746.6 with partial English translation.

(Continued)

*Primary Examiner* — Mark Le
(74) *Attorney, Agent, or Firm* — Wenderoth, Lind & Ponack, L.L.P.

(57) ABSTRACT

A guide rail type vehicle of the present invention comprises a guide frame provided so as to be rotatable about a rotation axis perpendicular to the floor surface of a vehicle body; a plurality of guide wheels which forms gripping pairs aligned in the vehicle width direction so as to be able to grip a center guide rail, and which is arranged in the front-and-rear direction of the guide frame; equalizing links supporting two guide wheels, which are adjacent to each other in the front-and-rear direction, so as to be able to roll about a guide wheel shaft parallel to the rotation axis, and connecting the two guide wheels as a connected pair and being attached to the guide frame so as to be rotatable about a link shaft parallel to the rotation axis; and a steering link mechanism changing the steering angle of tires.

10 Claims, 14 Drawing Sheets

(56) References Cited

U.S. PATENT DOCUMENTS

| | | | | |
|---|---|---|---|---|
| 4,346,659 | A * | 8/1982 | Binder | 104/247 |
| 6,364,215 | B1 | 4/2002 | Andre et al. | |
| 6,431,082 | B1 | 8/2002 | Kummeter et al. | |
| 6,477,963 | B1 * | 11/2002 | Weule et al. | 104/243 |
| 8,074,577 | B2 * | 12/2011 | Morichika et al. | 104/139 |
| 8,234,022 | B2 * | 7/2012 | Morichika et al. | 701/19 |
| 8,561,547 | B2 * | 10/2013 | Shiroyama et al. | 105/215.2 |
| 8,839,721 | B2 * | 9/2014 | Maeyama et al. | 105/215.2 |
| 2010/0065692 | A1 | 3/2010 | Andre | |
| 2011/0271868 | A1 * | 11/2011 | Kurahashi et al. | 105/141 |
| 2012/0012028 | A1 * | 1/2012 | Shiroyama et al. | 105/157.1 |
| 2012/0017800 | A1 * | 1/2012 | Kurahashi et al. | 105/182.1 |

FOREIGN PATENT DOCUMENTS

| | | |
|---|---|---|
| FR | 514718 | 3/1921 |
| JP | 48-51418 | 7/1973 |
| JP | 48-054608 | 8/1973 |
| JP | 49-109312 | 9/1974 |
| JP | 52-41313 | 3/1977 |
| JP | 52-141911 | 11/1977 |
| JP | 52-143607 | 11/1977 |
| JP | 59-29559 | 2/1984 |
| JP | 59-139456 | 9/1984 |
| JP | 4-185577 | 7/1992 |
| JP | 7-40361 | 7/1995 |
| JP | 2001-48007 | 2/2001 |
| JP | 2001-48008 | 2/2001 |
| JP | 2002-019603 | 1/2002 |
| JP | 2003-146204 | 5/2003 |
| JP | 2004-268700 | 9/2004 |
| JP | 2006-347426 | 12/2006 |
| JP | 2010-510932 | 4/2010 |
| JP | 2010-195310 | 9/2010 |
| JP | 2010-202164 | 9/2010 |
| JP | 2010-215120 | 9/2010 |
| JP | 2010-221949 | 10/2010 |

OTHER PUBLICATIONS

International Search Report issued Oct. 25, 2011 in International (PCT) Application No. PCT/JP2011/066834 with English translation.

Written Opinion of the International Searching Authority issued Oct. 25, 2011 in International (PCT) Application No. PCT/JP2011/066834 with English translation.

Japanese Notice of Reasons for Rejection issued Oct. 16, 2012 in Japanese Patent Application No. 2010-283192 with English translation.

* cited by examiner

GUIDE RAIL TYPE VEHICLE

TECHNICAL FIELD

The present invention relates to a guide rail type vehicle that travels along a center guide rail.

Priority is claimed on Japanese Patent Application No. 2010-283192, filed Dec. 20, 2010, the content of which is incorporated herein by reference.

BACKGROUND ART

In recent years, as new transportation system other than buses or trains, some of innovative transportation systems have garnered attention. One of the transportation systems is known in which a vehicle having wheels formed from rubber tires runs along a central guide rail.

As for this type of vehicle, for example, there is one disclosed in the following PTL 1. A running device of the vehicle described in PTL 1 is provided with a plurality of guide wheels that are aligned in the vehicle width direction to form pairs so as to grip a center guide rail, a frame provided so as to be rotatable about an axis perpendicular to the floor surface of a vehicle body, and a steering link mechanism that changes the steering angle of wheels in association with the rotation of the frame about a rotation axis. Each guide wheel is attached to the frame so as to be rotatable about a guide wheel shaft parallel to the rotation axis. This running device has two gripping pairs that are arranged in the front-and-rear direction. That is, this running device has a total of four guide wheels.

CITATION LIST

Patent Literature

[PTL 1] Japanese Unexamined Patent Application, First Publication No. 2006-347426 (FIG. 5)

SUMMARY OF INVENTION

Technical Problem

In the vehicle described in the above PTL 1, the guide wheels are enlarged in order to reduce a local load applied to the guide wheels to improve the durability of the guide wheels. However, since the guide wheels are enlarged, the height of the running device including the guide wheels will become high. It is preferable that the height of the running device be as low as possible in order to secure the stability of the vehicle body during travel on a curved travel road or the like.

Thus, a method of reducing the load applied to one guide wheel while making the guide wheels small may be considered by increasing the number of guide wheels. However, there are problems with simply providing a number of small guide wheels. That is, if there is a step, such as a joint of the center guide rail, the guide wheels respond to this step sensitively because the guide wheels are small, the steering angle of the tires will change in a jerky manner, and the ride quality will deteriorate.

The invention pays attention to the problems of the related art as described above, and an object thereof is to provide a guide rail type vehicle that can prevent degradation of ride quality while having small guide wheels.

Solution to Problem

The guide rail type vehicle related to the invention for solving the above problems is a guide rail type vehicle that travels along a center guide rail including a guide frame provided so as to be rotatable about a rotation axis perpendicular to the floor surface of a vehicle body; a plurality of guide wheels which forms gripping pairs aligned in the vehicle width direction so as to be able to grip the center guide rail, and which is arranged in the front-and-rear direction of the guide frame; an equalizing link supporting one guide wheel of the plurality of guide wheels and another guide wheel located on the front or rear side of the guide frame with respect to the one guide wheel so as to be able to roll about a guide wheel shaft parallel to the rotation axis, the equalizing link connecting the one guide wheel and the other guide wheel as a connected pair and being attached to the guide frame so as to be rotatable about a link shaft parallel to the rotation axis; and a steering link mechanism changing the steering angle of wheels in association with the rotation of the guide frame about the rotation axis.

In the vehicle concerned, even if one guide wheel reaches a stepped portion of the center guide rail and receives an abrupt and small lateral load from this stepped portion, the remaining guide wheel that has not reached the stepped portion then receives a relatively stable lateral load from the center guide rail. For this reason, the guide frame connected with the two guide wheels via the equalizing link receives a lateral load obtained by equalizing the lateral loads that the two guide wheels have received, respectively, using this equalizing link. Thereby, in the vehicle concerned, even if the guide wheels reach a stepped portion, such as a joint of the center guide rail, the steering angle of the tires does not change in a jerky or abrupt manner, and even if the guide wheels are made small, degradation of ride quality can be prevented.

Here, in the guide rail type vehicle, a plurality of the connected pairs may be arranged in the front-and-rear direction.

In the vehicle concerned, since the number of guide wheels increases, even if the guide wheels are made small, the load per one guide wheel does not become large, and the durability of the guide wheels can be secured.

Additionally, in the guide rail type vehicle, the equalizing link may be a link that connects the two guide wheels each other as the connected pair, the two guide wheels being adjacent to each other in the front-and-rear direction on one side in the vehicle width direction with reference to the center guide rail.

In this case, preferably, an interval between the link shaft of the equalizing link that connects the two guide wheels that form the connected pair, and the guide wheel shaft of the guide wheel of the two guide wheels, which is far from the rotation axis, is greater than the interval between the link shaft, and the guide wheel shaft of the guide wheel near the rotation axis.

In the vehicle concerned, the amount of displacement in the link shaft can be suppressed even if the guide wheel that contacts the stepped portion of the center guide rail first and is far from the rotational axis is greatly displaced due to a step. Hence, in the vehicle concerned, ride quality during travel at the stepped portion of the center guide rail can be further improved.

Additionally, in the guide rail type vehicle, the plurality of guide wheels that form the three or more gripping pairs may be arranged outside the vehicle body in the front-and-rear direction with reference to the rotation axis of the guide frame, and the guide rail type vehicle may include a W equalizing link as the equalizing link that connects, the two guide wheels each other as the connected pair, the two guide wheels being located on the outermost side among the plurality of guide wheels arranged outside the vehicle body in the front-and-rear direction and are adjacent to each other in the front-and-rear direction; and an LW equalizing link that supports the guide wheel, which is arranged closer to the central side of the vehicle body in the front-and-rear direction than the two guide wheels connected by the W equalizing link, among the plurality of guide wheels arranged outside the vehicle body, so as to be able to roll about the guide wheel shaft of the guide wheel, and that supports the W equalizing link so as to be rotatable about the link shaft of the W equalizing link, connects the guide wheels and the W equalizing link to each other, and is attached to the guide frame so as to be rotatable about an LW link shaft parallel to the rotation axis.

In this case, the plurality of guide wheels that form the two or more gripping pairs may be arranged on the central side of the vehicle body in the front-and-rear direction with reference to the rotation axis of the guide frame, and the plurality of guide wheels that are arranged on the central side of the vehicle body each may form one of the connected pair, and may be connected to each other by the equalizing link.

In the vehicle concerned, for example, when the vehicle is advancing forward, even if there is a stepped portion, such as a joint of the center guide rail, first, the guide wheel that contacts the stepped portion of the center guide rail is connected with the other guide wheel by the W equalizing link, and this W equalizing link is further connected with the other guide wheel by the LW equalizing link. Therefore, the lateral load that the guide wheel that contacts the stepped portion first receives from the stepped portion is equalized by the W equalizing link, and is further equalized by the LW equalizing link. Hence, in the vehicle concerned, ride quality during travel at the stepped portion of the center guide rail can be further improved.

Additionally, the guide rail type vehicle may include a first W equalizing link as the equalizing link that connects the two guide wheels that form the connected pair, a second W equalizing link as the equalizing link that connects the two guide wheels that form the connected pair arranged in the front-and-rear direction with respect to the first W equalizing link, and an LL equalizing link that supports the first W equalizing link so as to be rotatable about the link shaft of the first W equalizing link and that supports the second W equalizing link so as to be rotatable about the link shaft of the second W equalizing link, connects the first W equalizing link and the second W equalizing link, and is attached to the guide frame so as to be rotatable around an LL link shaft parallel to the rotation axis.

In the vehicle concerned, even if there is a stepped portion, such as a joint of the center guide rail, the guide wheel that contacts this stepped portion is connected with the other guide wheel by the first W equalizing link, and this first W equalizing link is further connected with the second W equalizing link by the LL equalizing link. Therefore, the lateral load that this guide wheel receives from the stepped portion is equalized by the W equalizing link, and is further equalized by the LL equalizing link. Hence, even in the vehicle concerned, ride quality during travel at the stepped portion of the center guide rail can be further improved.

Additionally, in the guide rail type vehicle, the equalizing link may have a first cross equalizing link that connects two guide wheels each other as the connected pair, the two guide wheels being the guide wheel arranged on one side in the vehicle width direction with reference to the center guide rail, in the two guide wheels that form one gripping pair, and the guide wheel arranged on the other side in the vehicle width direction, in the two guide wheels that form the other gripping pair that is adjacent to the one gripping pair in the front-and-rear direction, and a second cross equalizing link that connects two guide wheels each other as the connected pair, the two guide wheels being the guide wheel arranged on the other side in the vehicle width direction, in the two guide wheels that form one gripping pair, and the guide wheel arranged on the one side in the vehicle width direction, in the two guide wheels that form the other gripping pair, and a clearance adjusting rod may be pin-coupled to the first cross equalizing link and the second cross equalizing link, respectively, so as to secure the interval between the two guide wheels that form the gripping pair.

In the vehicle concerned, even if one guide wheel reaches a stepped portion of the center guide rail and receives an abrupt and small lateral load from this stepped portion, the remaining guide wheel that has not reached the stepped portion receives a relatively stable lateral load from the center guide rail at that time. For this reason, the guide frame connected with the two guide wheels via the cross equalizing link receives a lateral load obtained by equalizing the lateral loads that the two guide wheels have received, respectively, using this cross equalizing link. For this reason, in the vehicle concerned, even if the guide wheels reach a stepped portion, such as a joint of the center guide rail, the steering angle of the tires does not change in a jerky or abrupt manner, and even if the guide wheels are made small, degradation of ride quality can be improved.

Additionally, in the guide rail type vehicle, the clearance adjusting rod may have a length adjusting tool that adjusts its own length.

In the vehicle concerned, the mutual interval between the two guide wheels that form the gripping pair can be changed by changing the length of the clearance adjusting rod. For this reason, even if the guide wheels are worn out, it is possible to cope with this easily.

Additionally, in the guide rail type vehicle, a plurality of holes which is configured to pin-couple with the clearance adjusting rod may be formed in advance in at least one cross equalizing link of the first cross equalizing link and the second cross equalizing link.

In the vehicle concerned, the position where the clearance adjusting rod is pin-coupled with the cross equalizing links can be changed. Thus, the mutual interval between the two guide wheels that form the gripping pair can be changed. For this reason, even if the guide wheels are worn out, it is possible to cope with this easily.

Additionally, in the guide rail type vehicle, the clearance adjusting rod may have a resilient body that is resiliently deformed in its own longitudinal direction.

In the vehicle concerned, in a case where the guide wheels have received an abrupt lateral load, the length of the clearance adjusting rod can be changed to absorb this shocking lateral load, and the ride quality can be improved.

Additionally, the guide rail type vehicle may include a clearance adjustor that adjusts the interval between the two guide wheels that form the gripping pair.

In the vehicle concerned, the mutual interval between the two guide wheels that form the gripping pair can be changed. Therefore, even if the guide wheels are worn out, it is possible to cope with this easily.

Additionally, in the guide rail type vehicle, the equalizing link may have a resilient body that is resiliently deformed in a direction in which the two guide wheels that form the gripping pair are arranged.

In the vehicle concerned, in a case where the guide wheels have received an abrupt lateral load, the equalizing link that supports the guide wheels is resiliently deformed. For this reason, the abrupt lateral load can be absorbed, and ride quality can be improved.

Additionally, the guide rail type vehicle may include a rotation suppressor that suppresses the rotation of the equalizing link about the link shaft.

In the vehicle concerned, in a case where the guide wheels have received an abrupt lateral load, the rotation of the equalizing link that supports the guide wheels is suppressed. For this reason, abrupt steering of the wheels can be suppressed, and the ride quality can be improved as a result.

Additionally, in the guide rail type vehicle, the guide wheel may have a main body of which the peripheral surface is formed with the guide wheel shaft as a center, and flanges that are arranged on both sides in the direction in which the guide wheel shaft extends with reference to the main body, and that have a greater external diameter than the external diameter of the main body. In this case, preferably, the link shaft is provided so as to be movable in the direction in which the link shaft extends with respect to the guide frame.

Advantageous Effects of Invention

In the present invention, the guide frame connected with the two guide wheels that form the connected pair via the equalizing link receives a lateral load obtained by equalizing the lateral loads that the two guide wheels have received, respectively, using this equalizing link. For this reason, according to the invention, even if the guide wheels reach a stepped portion, such as a joint of the center guide rail, the steering angle of the wheels does not change in a jerky or abrupt manner, and even if the guide wheels are made small, degradation of the ride quality can be prevented.

DESCRIPTION OF EMBODIMENTS

Figure 1:
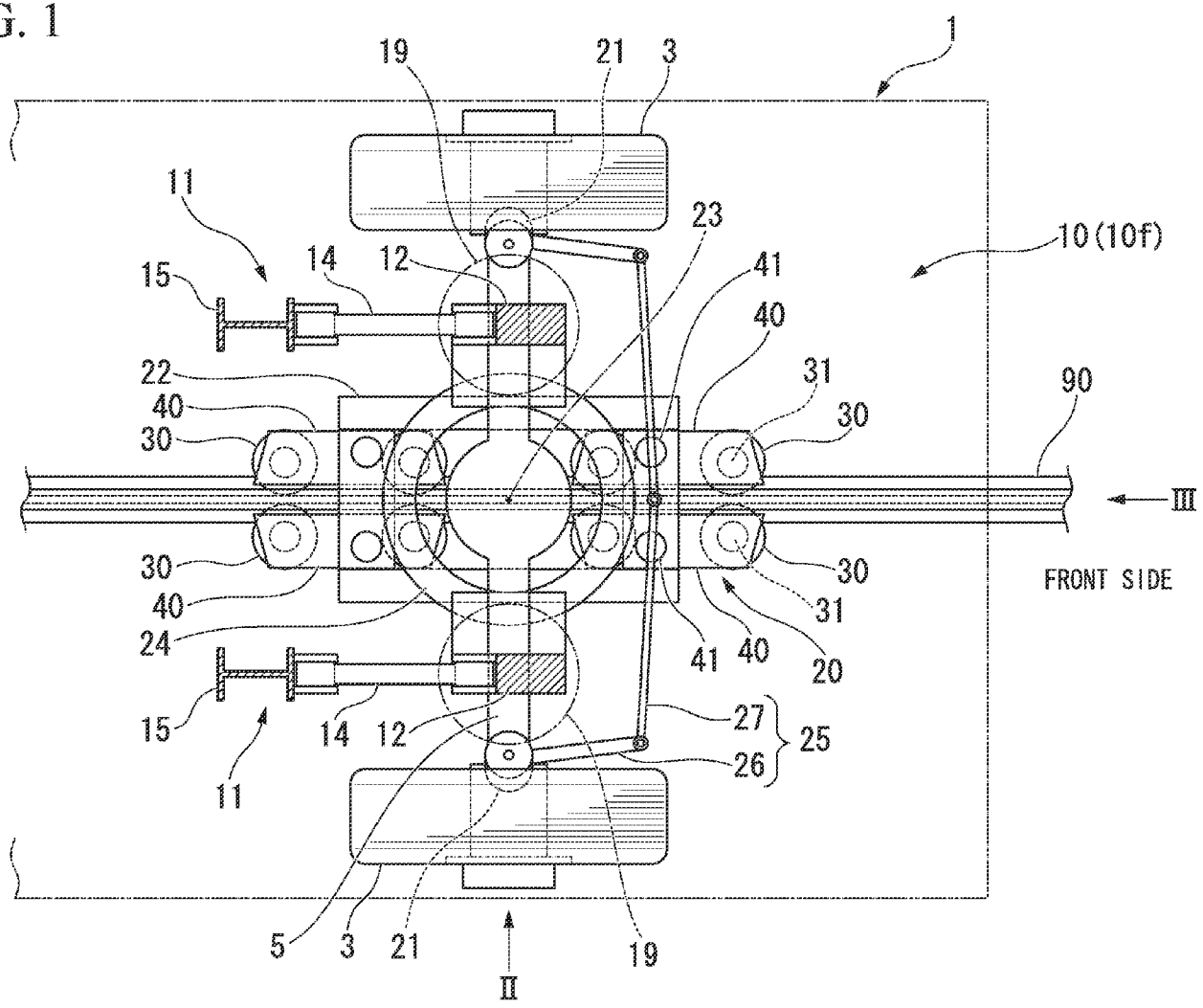
FIG. 1 is a plan view of a running device of a guide rail type vehicle in a first embodiment related to the invention.

Hereinafter, various embodiments of a guide rail type vehicle of the invention will be described referring to the drawings. In addition, respective guide rail type vehicles in the following respective embodiments are vehicles of a novel center guide rail type transportation system.

First Embodiment

First, a first embodiment of the guide rail type vehicle related to the invention will be described with reference to FIGS. 1 to 6.

Figure 5:
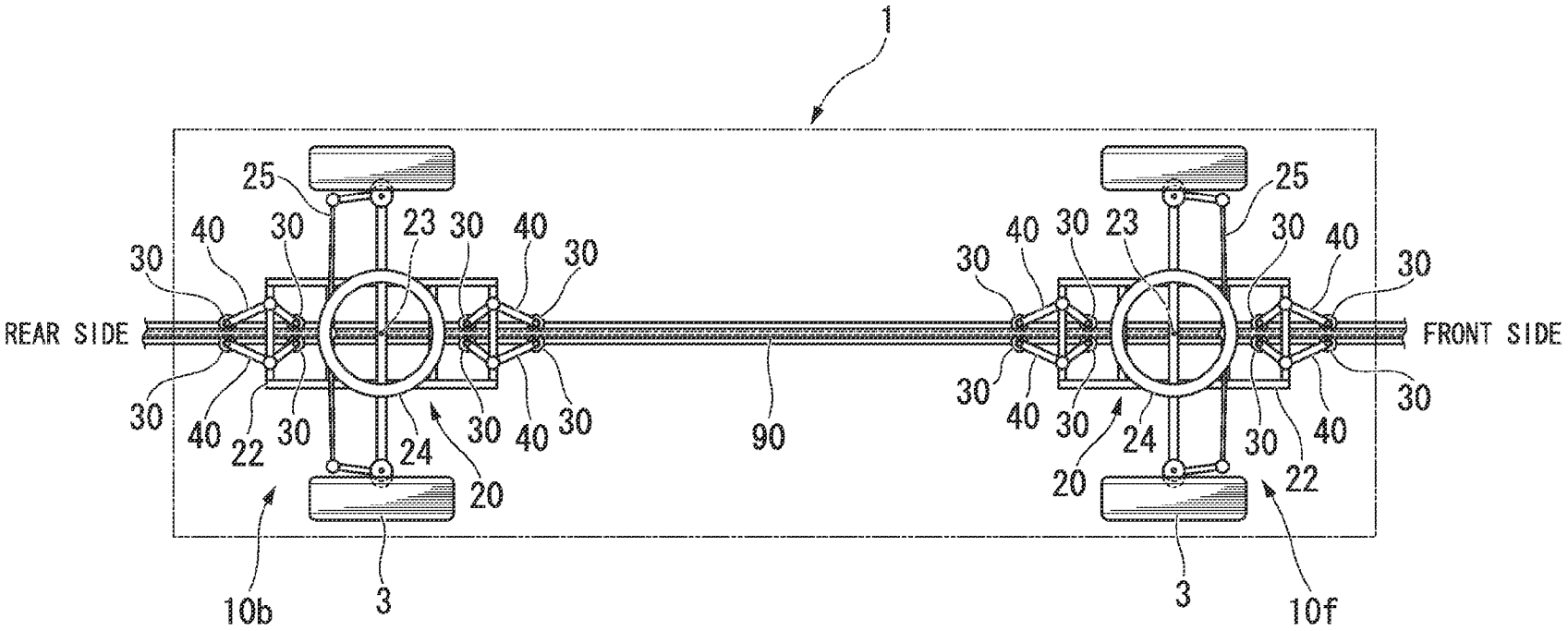
FIG. 5 is a schematic view of the guide rail type vehicle in the first embodiment related to the invention.

The vehicle of the present embodiment, as shown in FIG. 5, is provided with a vehicle body 1, a front running device 10*f* that is arranged on the front side below the vehicle body 1, and a rear running device 10*b* that is arranged on the rear side below the vehicle body 1.

Figure 2:
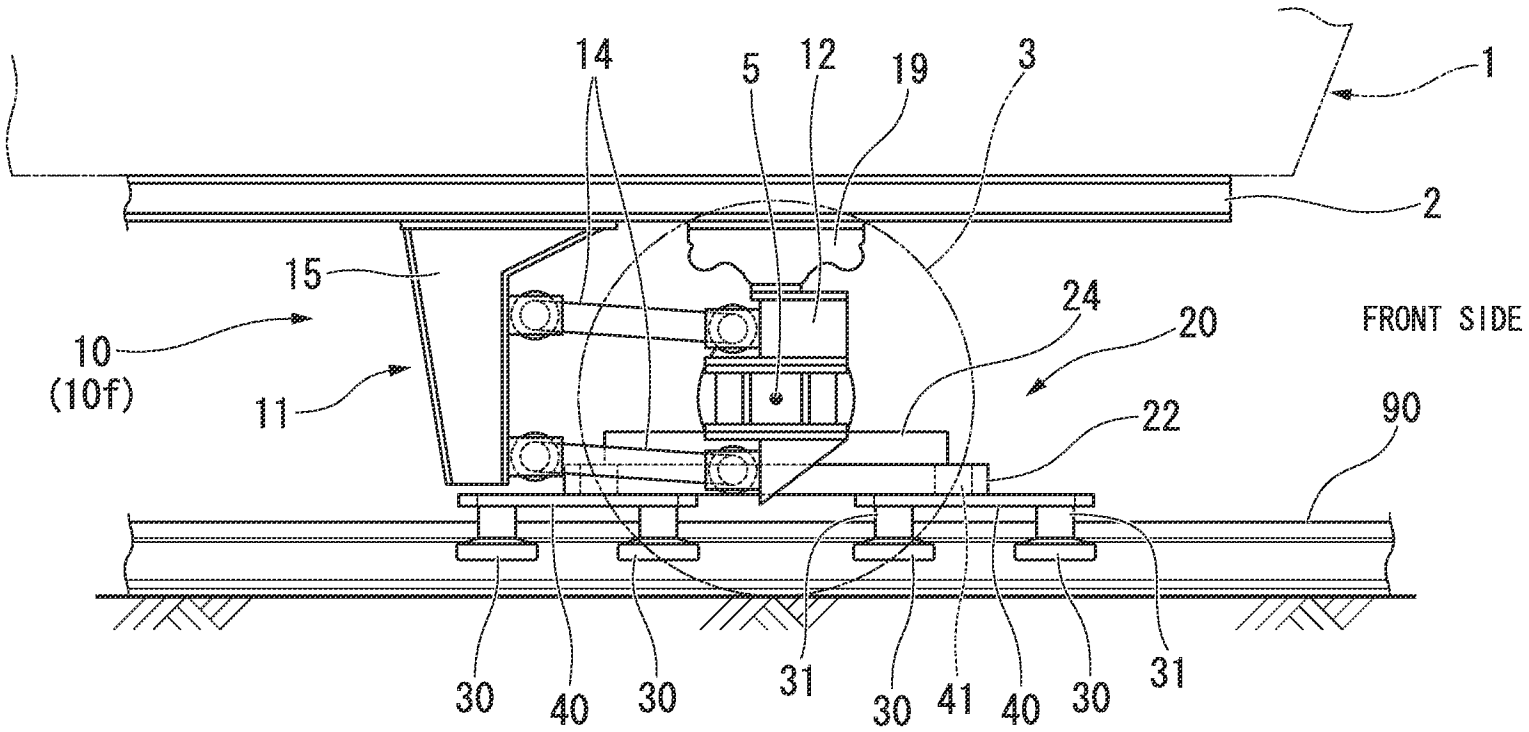
FIG. 2 is a view as seen from arrow II in FIG. 1.
Figure 3:
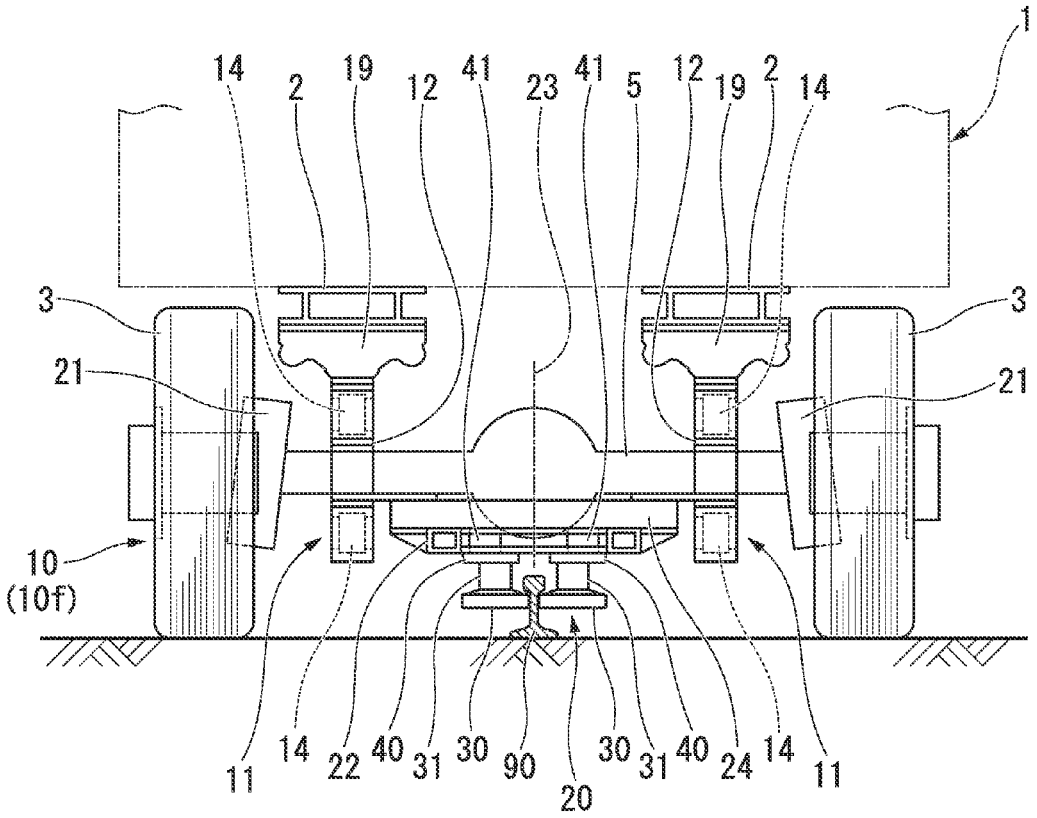
FIG. 3 is a view as seen from arrow III in FIG. 1.

Each running device 10 (10*f*, 10*b*), as shown in FIGS. 1 to 3, is provided with a pair of right and left tires 3, an axle 5 that connects the pair of tires 3, a pair of right and left suspension systems 11 that supports the axle 5 and a pair of tires 3, and a steering guide device 20 that turns the tires 3 to a direction along a center guide rail 90. In addition, since the front running device 10*f* and the rear running device 10*b* have the same configuration except that the front and rear directions are reversed, the front running device 10*f* will be described below unless otherwise noted.

The suspension systems 11 are provided with truck frames 12 that support the axle 5, a pair of right and left air springs 19 that is arranged between the truck frames 12 and an underframe 2 of the vehicle body 1, and a plurality of links 14 and suspension frames 15 that support the truck frames 12 so as to be displaceable in an up-and-down direction.

The suspension frame 15 is fixed to the underframe 2 of the vehicle body 1 so as to be located on the rear side of the truck frame 12. In addition, in the rear running device 10*b*, as mentioned above, the front and rear directions are reversed compared to the front running device 10*f*. Thus, the suspension frame 15 is located on the front side of the truck frame 12.

The suspension frame 15 and the truck frame 12 are connected by two links 14 that are arranged in the front-and-rear direction and are parallel to each other. One end portion of each of the links 14 is pin-coupled with the suspension frame 15, and the other end of each of the links 14 is pin-coupled with the truck frame 12. The suspension frame 15, the truck frame 12, and the two links 14 constitute a parallel four-link mechanism. For this reason, the truck frame 12 can move up and down without changing its orientation with respect to the suspension frame 15. Additionally, the two links 14 also serve as traction rods for transmitting the driving force or decelerating force of the tire 3 to the vehicle body 1.

The air spring 19 has an upper end portion and a lower end portion, the upper end portion is attached to the underframe 2 of the vehicle body 1 and the lower end portion is attached to an upper end of the truck frame 12. The relative vertical vibration of the tire 3 and the axle 5 with respect to the vehicle body 1 is relaxed by the air spring 19.

The steering guide device 20 includes kingpins 21 that becomes steering shafts of the tires 3, a guide frame 22 that is arranged below the truck frames 12, a rotation axis bearing 24 that supports the guide frame 22 so as to be rotatable about a rotation axis 23 perpendicular to the floor surface of the vehicle body 1, a steering link mechanism 25 that changes the steering angle of the tires 3 in association with the rotation of the guide frame 22 about the rotation axis 23, guide wheels 30 that are aligned in a vehicle width direction to form gripping pairs in order to be able to grip the center guide rail 90 and that are arranged in more than one state in the front-and-rear direction of the guide frame 22, and an equalizing link 40 that connects two guide wheels 30. In addition, the steering link mechanism 25 is omitted in FIGS. 2 and 3 in order to make these drawings easily seen.

The guide frame 22 forms a rectangular frame, and the direction in which a pair of short sides faces each other is the front-and-rear direction of the guide frame 22.

As mentioned above, the rotation axis 23 of the rotation axis bearing 24 is an axis perpendicular to the floor surface of the vehicle body 1, and is an axis passing through the center of the axle 5 in the longitudinal direction, that is, the axis passing through an intermediate position between the pair of right and left tires 3. The rotation axis bearing 24 is arranged between the pair of truck frames 12 and the guide frame 22 in the up-and-down direction. The rotation axis bearing 24 has an inner ring and an outer ring, one of the inner ring and the outer ring is fixed to lower parts of the pair of truck frames 12, and the other is fixed to an upper part of the guide frame 22. The center of the guide frame 22 in the front-and-rear direction and the right-and-left direction is located on the rotation axis 23.

The steering link mechanism 25 (FIG. 1) has a steering arm 26 that makes a rocking motion integrally with the tire 3 with reference to the kingpin 21 of the tire 3, and a steering rod 27 that connect the steering arm 26 and the guide frame 22. One end portion of the steering rod 27 is pin-coupled with an end portion of the steering arm 26, and the other end is pin-coupled with the guide frame 22. Hence, if the guide frame 22 rotates about the rotation axis 23, the steering rod 27 is displaced with this rotation, and the steering arm 26 and the tire 3 rotate about the kingpin 21 by this displacement. That is, the tire 3 is steered.

The number of gripping pairs each constituted by the two guide wheels 30 that grip the center guide rail 90 is four per one running device in the present embodiment, and these gripping pairs are arranged in the front-and-rear direction of the guide frame 22. Hence, in the present embodiment, one running device 10 has a total of eight guide wheels 30 (=4×2).

Figure 6:
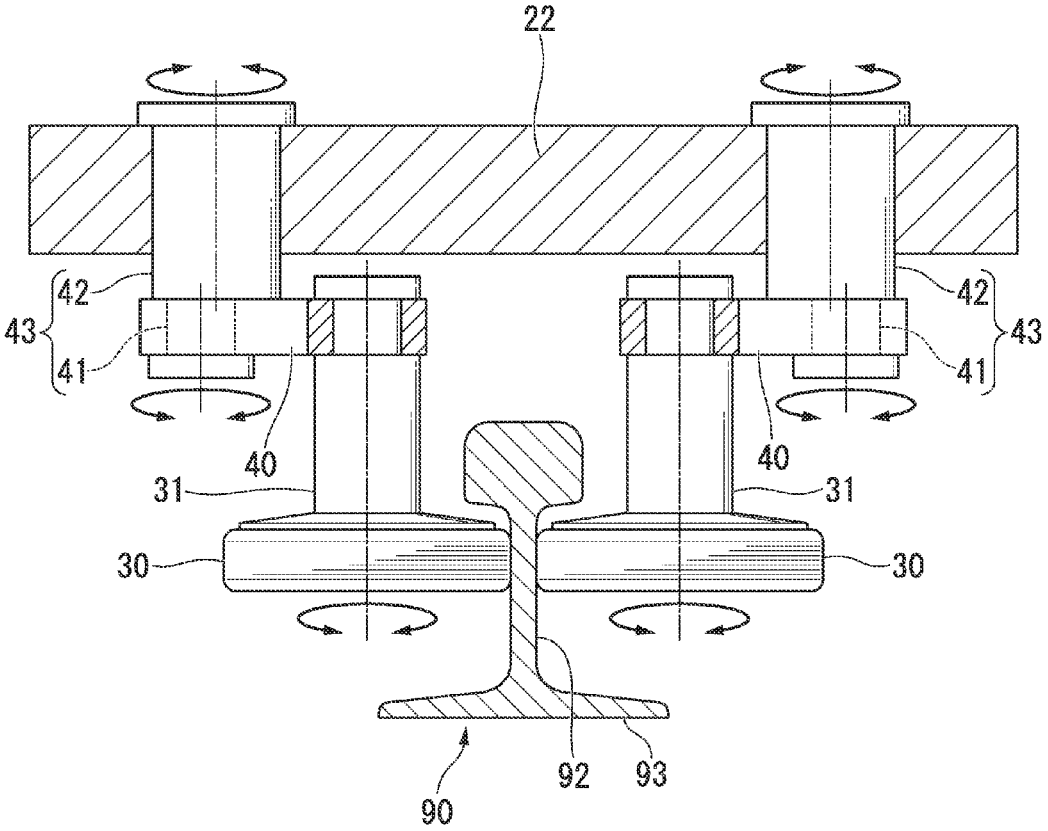
FIG. 6 is a front view of guide wheels and a clearance adjustor in the first embodiment related to the invention.

As shown in FIG. 6, the center guide rail 90 of the present embodiment is a railroad rail that has a head portion, a bottom portion, and a middle portion that connects the head portion and the bottom portion. The guide wheels 30 contact the middle portion of this railroad rail, and the part that contacts this middle portion is formed from resilient bodies, such as urethane rubber.

Figure 4:
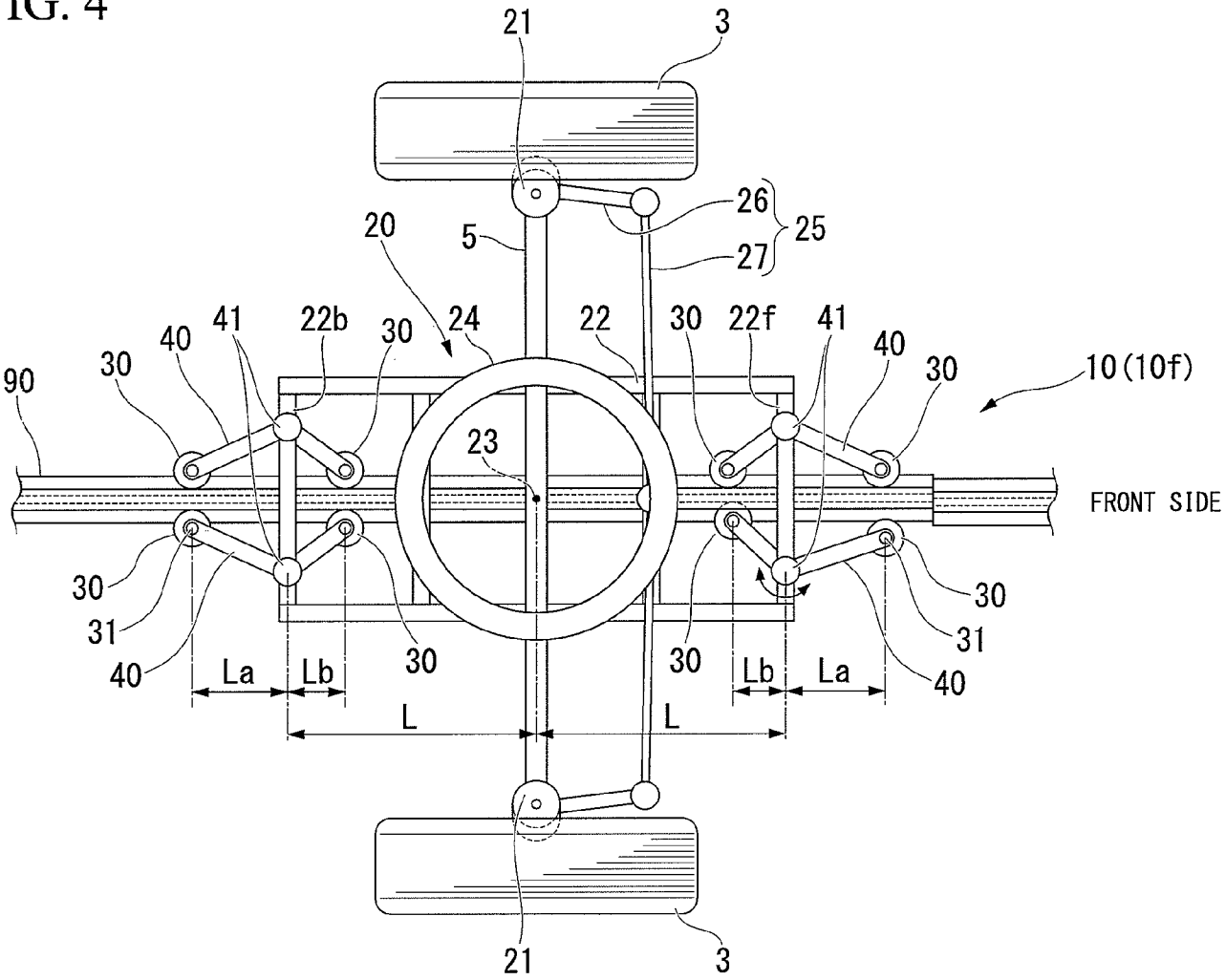
FIG. 4 is a schematic view of the running device of the guide rail type vehicle in the first embodiment related to the invention.

As shown in FIG. 4, the equalizing links 40 are links that connect the two guide wheels 30 as a connected pair. The two guide wheels 30 are arranged on one side in the vehicle width direction with reference to the center guide rail 90 and are adjacent to each other in the front-and-rear direction of the guide frame 22. Hence, the running device 10 of the present embodiment having a total of eight guide wheels 30 has the two guide wheels respectively on one side and the other side in the vehicle width direction, that is, a total of four equalizing links 40.

The equalizing link 40 supports the two guide wheels 30 that form a connected pair at both ends thereof so as to be able to roll about guide wheel shafts 31 parallel to the rotation axis 23. Additionally, the equalizing link 40 is attached to a front beam **22*f* or a rear beam 22*b* of the guide frame 22 so as to be rotatable about a link shaft 41 parallel to the rotation axis 23 at a substantially central portion of the equalizing link 40**.

The distance L in the front-and-rear direction between the link shaft 41 of the equalizing link 40 attached to the front beam **22*f* of the guide frame 22, and the rotation axis 23 is equal to the distance L in the front-and-rear direction between the link shaft 41 of the equalizing link 40 attached to the rear beam 22*b* of the guide frame 22, and the rotation axis 23. Additionally, the interval La in the front-and-rear direction between the link shaft 41 of the equalizing link 40, and the guide wheel shaft 31 of the guide wheel 30 far from the rotation axis 23 in the two guide wheels 30 connected by this equalizing link 40 is greater than the interval Lb in the front-and-rear direction between the link shaft 41 and the guide wheel shaft 31 of the guide wheel 30 near to the rotation axis 23**. Specifically, the ratio of the interval La and the interval Lb is, for example, Interval La:Interval Lb=5:3.

Next, the operation of the running device 10 described above will be described.

If the vehicle reaches a portion that is curved in the center guide rail 90, the guide wheels 30 located inside the curve with reference to the center guide rail 90 contact the center guide rail 90 while rolling, and receive the lateral load in the vehicle width direction from the center guide rail 90. This lateral load is transmitted to the guide frame 22 via the equalizing links 40, and rotates the guide frame 22 about the rotation axis 23.

If the guide frame 22 rotates about the rotation axis 23 as mentioned above, the steering rod 27 of the steering link mechanism 25 is displaced with this rotation. From this displacement, the steering arm 26 and the tire 3 rotate about the kingpin 21. That is, the tire 3 is steered.

Here, a case where the guide wheel shafts 31 of the guide wheels 30 are provided in the guide frame 22, and the guide wheel shafts 31 do not move relative to the guide frame 22 will be considered.

In such a case, if the guide wheels 30 reach a stepped portion, such as a joint of the center guide rail 90, the lateral load that the guide wheels 30 receive changes in a jerky or abrupt manner. This tendency is marked, particularly in a case where the external diameter of the guide wheels 30 is small. For this reason, the steering angle of the tires 3 will also change in a jerky or abrupt manner, and the ride quality will deteriorate.

On the other hand, in the present embodiment, even if one guide wheel 30 of the two guide wheels 30 that form a connected pair reaches the stepped portion of the center guide rail 90 and the guide wheel 30 tends to move in a jerky or abrupt manner, the remaining guide wheel 30 connected with this guide wheel 30 via the equalizing links 40 has not reached the stepped portion of the center guide rail 90, and movement of the guide wheel 30 that has reached the stepped portion is suppressed.

In other words, in the present embodiment, even if one guide wheel 30 reaches the stepped portion of the center guide rail 90 and receives an abrupt and small lateral load from this stepped portion, the remaining guide wheel 30 that has not reached the stepped portion receives a relatively stable lateral load from the center guide rail 90 at that time. Therefore, the guide frame 22 connected with the two guide wheels 30 via the equalizing links 40 receives a lateral load obtained by equalizing the lateral loads that the two guide wheels 30 have received, respectively, using the equalizing links 40.

For this reason, in the present embodiment, even if the guide wheels 30 reach a stepped portion, such as a joint of the center guide rail 90, the steering angle of the tires 3 does not change in a jerky or abrupt manner, and the ride quality can be improved.

Additionally, in the present embodiment, with respect to a front equalizing link 40 of the guide frame 22, the interval La between the guide wheel shaft 31 of a front guide wheel 30 far from the rotation axis 23 and the link shaft 41 is greater than the interval Lb between the guide wheel shaft 31 of a rear guide wheel 30 near to the rotation axis 23, and the link shaft 41. For this reason, when the vehicle is advancing forward, the amount of displacement in the link shaft 41 can be suppressed even if the front guide wheel 30 that contacts the stepped portion of the center guide rail 90 first is greatly displaced due to a step. Similarly, in the present embodiment, with respect to a rear equalizing link 40 of the guide frame 22, the interval La between the guide wheel shaft 31 of a rear guide wheel 30 far from the rotation axis 23 and the link shaft 41 is greater than the interval Lb between the guide wheel shaft 31 of a front guide wheel 30 near to the rotation axis 23, and the link shaft 41. For this reason, when the vehicle is advancing rearward, the amount of displacement in the link shaft 41 can be suppressed even if the rear guide wheel 30 that contacts the stepped portion of the center guide rail 90 first is greatly displaced due to a step.

Therefore, in the present embodiment, the shaft interval between the respective shafts 41 and 31 of the equalizing link 40 is appropriately set. Thus, ride quality during travel at the stepped portion of the center guide rail 90 can be further improved.

Incidentally, in the present embodiment, as mentioned above, the outer peripheries of the guide wheels 30 are formed from urethane rubber that forms a resilient body. For this reason, if the travel distance of the vehicle becomes long, the external diameter of the guide wheels 30 becomes small, the interval in respective outer peripheral surfaces of the two guide wheels 30 that form the gripping pair is increased, and contact properties with the center guide rail 90 change due to the wear of the urethane rubber.

Thus, in the present embodiment, as shown in FIG. 6, a clearance adjustor 43 that adjusts the interval between the two guide wheels 30 that form a gripping pair is provided. The clearance adjustor 43 has the columnar link shaft 41 that is the center of rotation of the equalizing link 40, and a columnar interval adjustment shaft 42 rotatably attached to the guide frame 22. The interval adjustment shaft 42 is parallel to the link shaft 41 but is eccentric with respect to the link shaft 41. For this reason, if the clearance adjustor 43 is rotated about the interval adjustment shaft 42 with respect to the guide frame 22, the link shaft 41 can be moved in the vehicle width direction, and the interval between the two guide wheels 30 that form the gripping pair can be changed.

In addition, the clearance adjustor 43 may be rotated with respect to the guide frame 22 only when the interval between the guide wheels 30 is adjusted, and it is not preferable that clearance adjustor 43 rotates with respect to the guide frame 22, for example, during traveling of the vehicle. For this reason, for example, it is preferable to form a plurality of key ways in the interval adjustment shaft 42 of the clearance adjustor 43, to perform processing, such as inserting a pin into any one of the plurality of key ways, for example, during traveling of the vehicle, to constrain the clearance adjustor 43 to be non-rotatable.

As described above, in the present embodiment, the load per one guide wheel can be mitigated because a total of eight guide wheels 30 are provided for one running device 10. For this reason, even if the width (dimension in the direction of the guide wheel shaft) and external diameter of the guide wheels 30 are made small and the area of contact with the center guide rail 90 is made small, a local load applied to one guide wheel 30 does not increase, and the durability of the guide wheels 30 can be secured. In other words, in the present embodiment, the width and external diameter of the guide wheels 30 can be made small while maintaining the durability of the guide wheels 30. For example, the width of the guide wheels 30 can be 30 mm, and the external diameter of the guide wheels 30 can be 185 mm.

In this way, in the present embodiment, the guide wheels 30 can be made small. Thus, the height of the running device 10 including the guide wheels 30 can be made low. Hence, in the present embodiment, the center-of-gravity position of the vehicle body 1 arranged on the running device 10 can be made low, and the stability of the vehicle body 1 while traveling on a curved road can be enhanced.

Moreover, in the present embodiment, the guide wheels 30 are made small. Thus, as mentioned above, a railroad rail that is easily available can be adopted as the center guide rail 90, and shortening of rail construction and cost reduction of rail construction can be achieved. However, in the present invention, the center guide rail 90 does not need to be a railroad rail, and the center guide rail may be, for example, I-steel, H-steel, or the like.

For this reason, in the present embodiment, the size of the guide wheels 30 is reduced as described above. However, even if the guide wheels 30 reach a stepped portion, such as a joint of the center guide rail 90, the lateral loads that the two guide wheels 30 that form a connected pair receive, respectively, are equalized by the equalizing link 40. Thus, the steering angle of the tires 3 does not change in a jerky or abrupt manner, and deterioration of the ride quality can be prevented.

Second Embodiment

Figure 7:
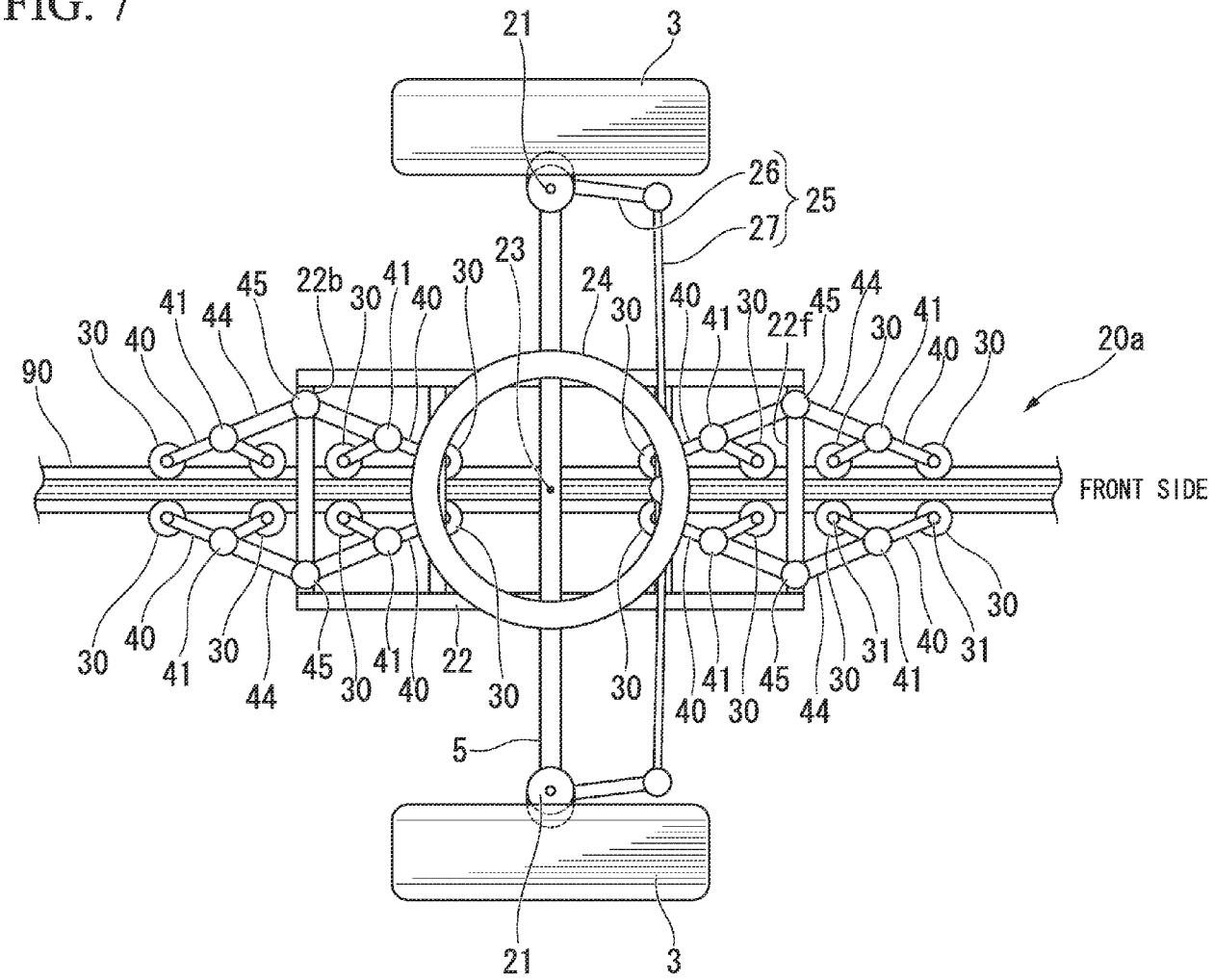
FIG. 7 is a schematic view of a running device of a guide rail type vehicle in a second embodiment related to the invention.

First, a second embodiment of the guide rail type vehicle related to the invention will be described referring to FIG. 7.

A steering guide device 20*a* of the vehicle of the present embodiment, similarly to the steering guide device 20 of the first embodiment, is provided with the kingpins 21, the guide frame 22, the rotation axis bearing 24, the guide wheels 30, equalizing links 40 and 44, and the steering link mechanism 25.

The number of gripping pairs each constituted by the two guide wheels 30 that grip the center guide rail 90 is eight per one running device in the present embodiment, and these gripping pairs are arranged in the front-and-rear direction of the guide frame 22. Hence, in the present embodiment, one running device 10 has a total of sixteen guide wheels 30 (=8×2).

In the present embodiment, as the equalizing links 40 and 44, there are an equalizing link 40 (hereinafter referred to as W equalizing link 40) that connects the two guide wheels 30 that are adjacent to each other in the front-and-rear direction of the guide frame 22 as the connected pair and an equalizing link 44 (hereinafter referred to as LL equalizing link 44) that connects two W equalizing links 40 that are adjacent to each other in the front-and-rear direction of the guide frame 22.

The W equalizing link 40 supports the two guide wheels 30 that form a connected pair at both ends thereof so as to be able to roll about guide wheel shafts 31 parallel to the rotation axis 23. Hence, the running device 10 of the present embodiment having a total of sixteen guide wheels 30 has four equalizing links respectively on one side and the other side in the vehicle width direction, that is, a total of eight W equalizing links 40.

The LL equalizing link 44 supports two W equalizing links 40 that are adjacent to each other in the front-and-rear direction of the guide frame 22 at both ends thereof so as to be rotatable about W link shafts 41 parallel to the rotation axis 23. Additionally, the LL equalizing link 44 is attached to the front beam 22*f* or the rear beam 22*b* of the guide frame 22 so as to be rotatable about an LL link shaft 45 parallel to the rotation axis 23 at a substantially central portion of the LL equalizing link 44.

Additionally, the interval La in the front-and-rear direction between the W link shaft 41 of the W equalizing link 40, and the guide wheel shaft 31 of the guide wheel 30 far from the rotation axis 23 in the two guide wheels 30 connected by this W equalizing link 40 is also greater than the interval Lb in the front-and-rear direction between the W link shaft 41 and the guide wheel shaft 31 of the guide wheel 30 near to the rotation axis 23, similarly to the first embodiment.

As described above, in the present embodiment, the number of the guide wheels 30 provided in one running device 10 is sixteen, which is twice as many as in the first embodiment. Therefore, the load per one guide wheel 30 can be further mitigated. For this reason, in the present embodiment, the width and external diameter of the guide wheels 30 can be made small while maintaining the durability of the guide wheels 30.

For this reason, in the present embodiment, even if the guide wheels 30 reach a stepped portion, such as a joint of the center guide rail 90, the lateral loads that the two guide wheels 30 that form a connected pair receive, respectively, are equalized by the W equalizing link 40, and the lateral loads that the two W equalizing links 40 that are adjacent to each other in the front-and-rear direction receive are further equalized by the LL equalizing link 44. Thus, the ride quality can be further improved.

Third Embodiment

Next, a third embodiment of the guide rail type vehicle related to the invention will be described with reference to FIGS. 8 to 9.

Figure 8:
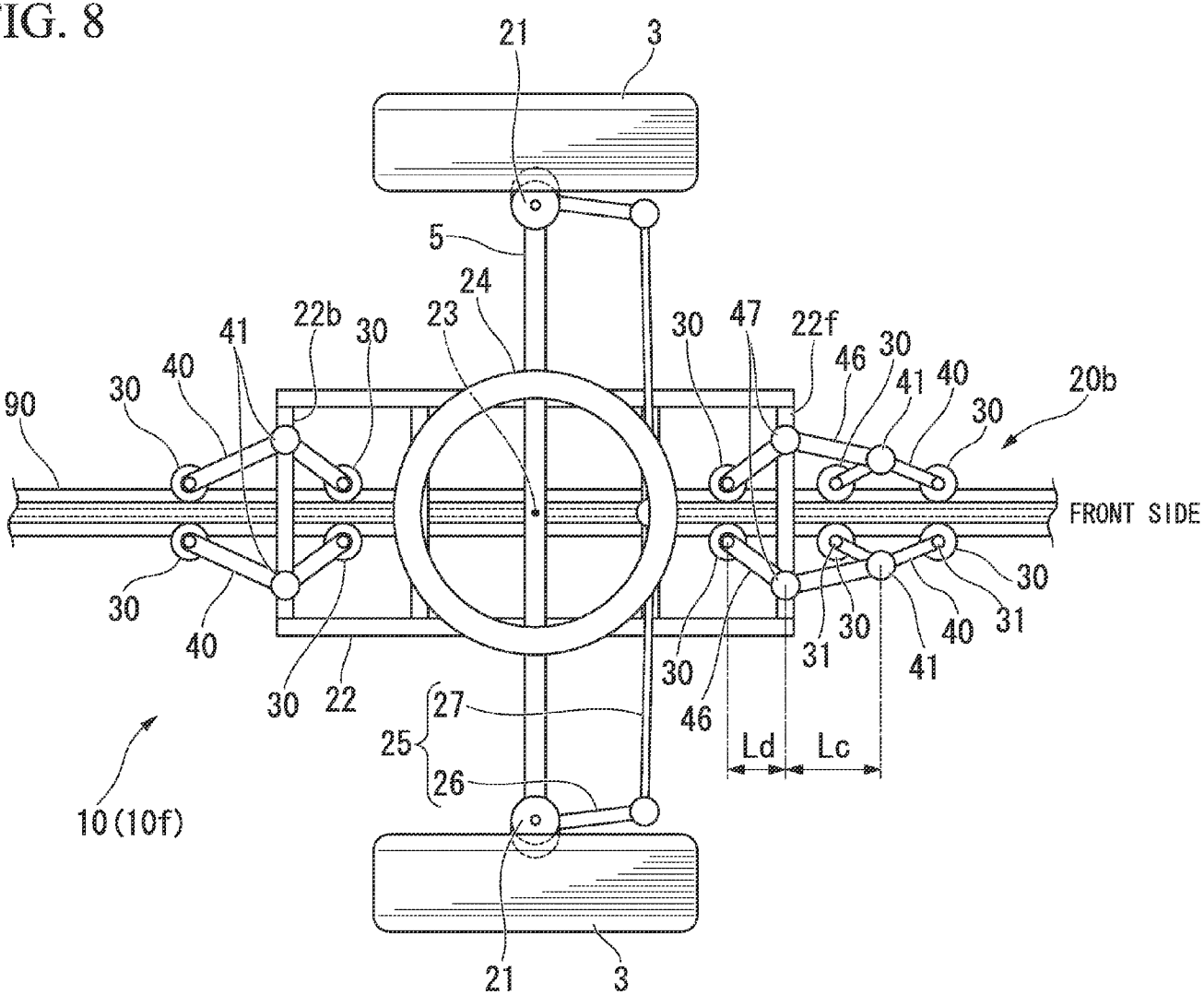
FIG. 8 is a schematic view of a running device of a guide rail type vehicle in a third embodiment related to the invention.
Figure 9:
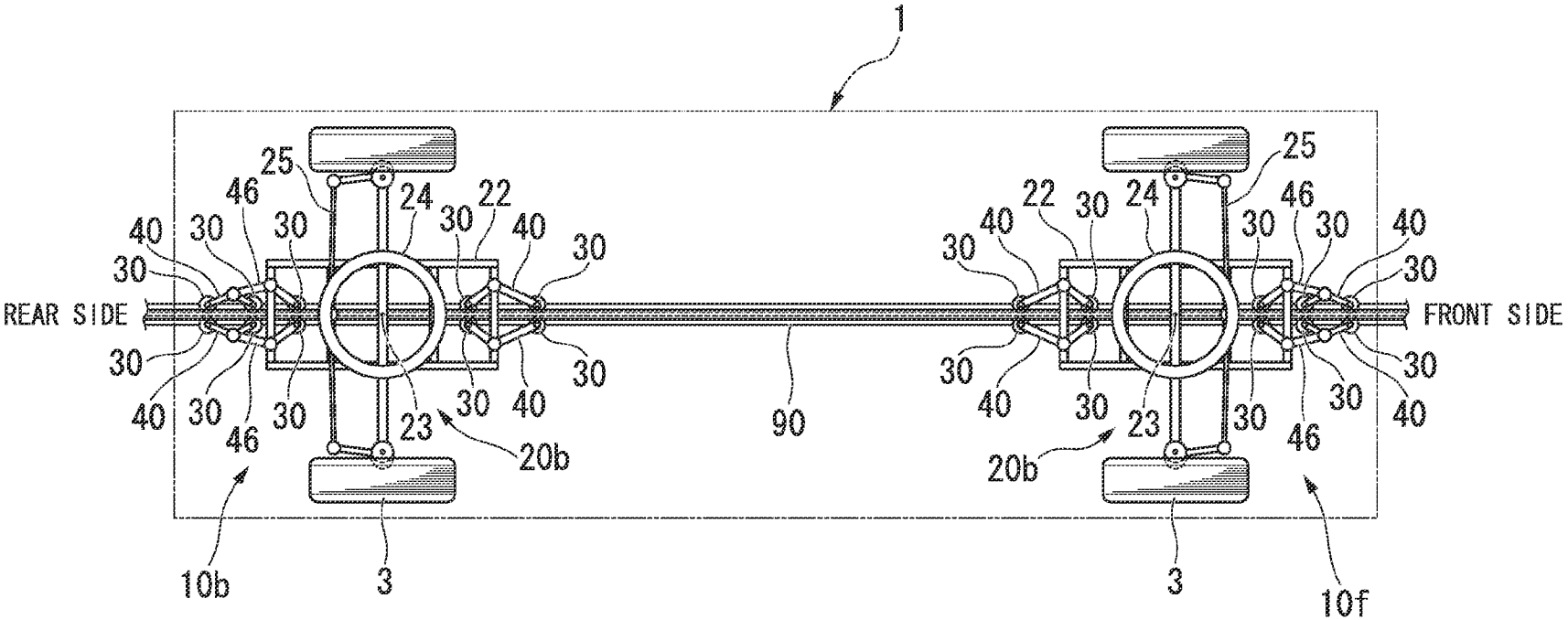
FIG. 9 is a schematic view of the guide rail type vehicle in the third embodiment related to the invention.

As shown in FIG. 8, a steering guide device 20*b* of the vehicle of the present embodiment, similarly to the steering guide device 20 of the first and second embodiments, is also provided with the kingpins 21, the guide frame 22, the rotation axis bearing 24, the guide wheels 30, equalizing links 40 and 46, and the steering link mechanism 25.

The number of gripping pairs each constituted by the two guide wheels 30 that grip the center guide rail 90 is five per one running device in the present embodiment. In the case of the front running device 10*f*, three gripping pairs are arranged closer to the front side than the rotation axis 23 in the front-and-rear direction of the guide frame 10, and two gripping pairs are arranged closer to the rear side than the rotation axis 23 in the front-and-rear direction. Hence, in the present embodiment, one running device 10 has a total of ten guide wheels 30 (=5×2).

In the present embodiment, as the equalizing links 40 and 46, there are a W equalizing link 40 that connects the two guide wheels 30 that are adjacent to each other in the front-and-rear direction of the guide frame 22 as the connected pair and an equalizing link 46 (hereinafter referred to as LW equalizing link 46) that connects a guide wheel 30 and the W equalizing link 40 arranged in the front-and-rear direction of the guide frame 22.

The W equalizing link 40, similarly to the second embodiment, supports the two guide wheels 30 that form a connected pair at both ends thereof so as to be able to roll about guide wheel shafts 31 parallel to the rotation axis 23.

The LW equalizing link 46 supports a W equalizing link 40 at one end thereof so as to be rotatable about a W link shaft 41 parallel to the rotation axis 23, and supports a guide wheel 30 arranged in the front-and-rear direction of this W equalizing link 40 of the guide frame 22 so as to be able to roll about the guide wheel shaft 31 at the other end thereof. Additionally, the LW equalizing link 46 is attached to the front beam 22*f* of the guide frame 22 so as to be rotatable about an LW link shaft 47 parallel to the rotation axis 23 at a substantially central portion of the LW equalizing link 46.

In the front running device 10*f*, in the foremost gripping pair and the next gripping pair among three gripping pairs closer to the front side than the rotation axis 23, the two guide wheels 30 that are adjacent to each other in the front-and-rear direction are connected as the connected pair by the aforementioned W equalizing link 40. Additionally, in the front running device 10*f*, the guide wheel 30 that is closer to the front side than the rotation axis 23 and is located on the rearmost side, that is, is closest to the rotation axis 23, is connected with the W equalizing link 40 by the LW equalizing link 46.

Additionally, in the front running device 10*f*, a plurality of guide wheels 30 that form two gripping pairs closer to the rear side than the rotation axis 23 are connected by the W equalizing links 40, that is, the equalizing links 40 in the first embodiment, with the two guide wheels 30 that are adjacent to each other in the front-and-rear direction as the connected pair. This W equalizing link 40 is attached to the rear beam 22*b* of the guide frame 22 so as to be rotatable about the link shaft 41 thereof.

Hence, the running device 10 of the present embodiment having a total of ten guide wheels 30 has two equalizing links respectively on both sides in the vehicle width direction, that is, a total of four W equalizing links 40, and has one equalizing link respectively on both sides in the vehicle width direction, that is, a total of two LW equalizing links 46.

Also in the present embodiment, similarly to the above respective embodiments, the interval in the front-and-rear direction between the W link shaft 41 of the W equalizing link 40, and the guide wheel shaft 31 of the guide wheel 30 far from the rotation axis 23 in the two guide wheels 30 connected by this W equalizing link 40 is also greater than the interval in the front-and-rear direction between the W link shaft 41 and the guide wheel shaft 31 of the guide wheel 30 near to the rotation axis 23, similarly to the first embodiment. Additionally, the interval Lc in the front-and-rear direction between the LW link shaft 47 of the LW equalizing link 46 and the W link shaft 41 of the W equalizing link 40 connected by this LW equalizing link 46 is greater than the interval Ld in the front-and-rear direction between the guide wheel shaft 31 of the guidewheel 30 connected by the LW equalizing link 46.

In the front running device 10*f*, as described above, the W equalizing links 40 and the LW equalizing links 46 are provided on the front side with reference to the rotation axis 23, and the W equalizing links 40 are provided on the rear side. On the other hand, in the rear running device 10*b*, as shown in FIG. 9, the W equalizing links 40 and the LW equalizing links 46 are provided on the rear side with reference to the rotation axis 23, and the W equalizing links 40 are provided on the front side.

Specifically, in the rear running device 10*b*, three gripping pairs are arranged closer to the rear side than the rotation axis 23 in the front-and-rear direction, and two gripping pairs are arranged closer to the front side than the rotation axis 23 in the front-and-rear direction. Also, in the rearmost gripping pair and the next rear gripping pair among three gripping pairs closer to the rear side than the rotation axis 23, the two guide wheels 30 that are adjacent to each other in the front-and-rear direction are connected as the connected pair by the W equalizing link 40. Additionally, in the rear running device 10*b*, the guide wheel 30 that is closer to the rear side than the rotation axis 23 and is located on the foremost side, that is, is closest to the rotation axis 23, is connected with the W equalizing link 40 by the LW equalizing link 46. Moreover, in the rear running device 10*b*, a plurality of guide wheels 30 that form two gripping pairs closer to the front side than the rotation axis 23 are connected by the W equalizing links 40, with the two guide wheels 30 that are adjacent to each other in the front-and-rear direction as the connected pair.

Hence, in the present embodiment, in the front running device 10*f* and the rear running device 10*h*, the guide wheels 30 and the various links 40 and 46 are located at positions where the front and rear thereof are reversed. That is, in the present embodiment, also in the front running device 10*f* or also in the rear running device Mb, three gripping pairs are arranged in the front-and-rear direction outside the vehicle body 1 in the front-and-rear direction, with reference to the rotation axis 23 of the guide frame 22. Also, the two guide wheels 30, which are adjacent to each other in the front-and-rear direction on the outermost side of the vehicle body 1 in the front-and-rear direction among a plurality of guide wheels 30 that form three gripping pairs, are connected by the W equalizing link 40, and this W equalizing link 40 and the remaining guide wheels 30 are connected by the LW equalizing link 46.

As described above, in the present embodiment, the number of the guide wheels 30 provided in one running device 10 is ten, which is more than in the first embodiment. Therefore, the load per one guide wheel can be further mitigated. For this reason, in the present embodiment, the width and external diameter of the guide wheels 30 can be made small while maintaining the durability of the guide wheels 30.

Additionally, also in the present embodiment, similarly to the first embodiment, when the guide wheels 30 reach a stepped portion, such as a joint of the center guide rail 90, the lateral loads that the two guide wheels 30 that form a connected pair have received, respectively, are equalized by the W equalizing links 40. Thus, deterioration of the ride quality can be prevented.

Moreover, in the present embodiment, when the vehicle is advancing forward, even if there is a stepped portion, such as a joint of the center guide rail 90, the guide wheels 30 of the front running device 10*f* that contact the stepped portion of the center guide rail 90 first are connected with other guide wheels 30 by the W equalizing links 40. Moreover, since the W equalizing links 40 are connected with other guide wheels 30 by the LW equalizing links 46, the lateral loads that the guide wheels 30 that contact the stepped portion first have received from the stepped portion are equalized by the W equalizing links 40, and are further equalized by the LW equalizing links 46. Moreover, in the present embodiment, when the vehicle is advancing rearward, even if there is a stepped portion, such as a joint of the center guide rail 90, the guide wheels 30 of the rear running device 10*b* that contact the stepped portion first are connected with other guide wheels 30 by the W equalizing links 40, and the W equalizing links 40 are connected with other guide wheels 30 by the LW equalizing links 46. Thus, the lateral loads that the guide wheels 30 contact the stepped portion first have received from the stepped portion are equalized by the W equalizing links 40, and are further equalized by the LW equalizing links 46. Hence, in the present embodiment, ride quality can be improved more than the first embodiment.

In addition, in the present embodiment, the W equalizing links 40 and the LW equalizing links 46 are provided only outside the vehicle body 1 in the front-and-rear direction with reference to the rotation axis 23 of the guide frame 22. However, the W equalizing links 40 and the LW equalizing links 46 may also be provided on the central side of the vehicle body 1 in the front-and-rear direction with reference to the rotation axis 23 of the guide frame 22.

Additionally, in the second embodiment as described earlier, the W equalizing links 40 and the LL equalizing links 44 are provided on both the outside and central side of the vehicle body 1 in the front-and-rear direction with reference to the rotation axis 23 of the guide frame 22. However, the W equalizing links 40 and the LL equalizing links 44 are provided only on the outside of the vehicle body 1 in the front-and-rear direction with reference to the rotation axis 23 of the guide frame 22.

Fourth Embodiment

Figure 10:
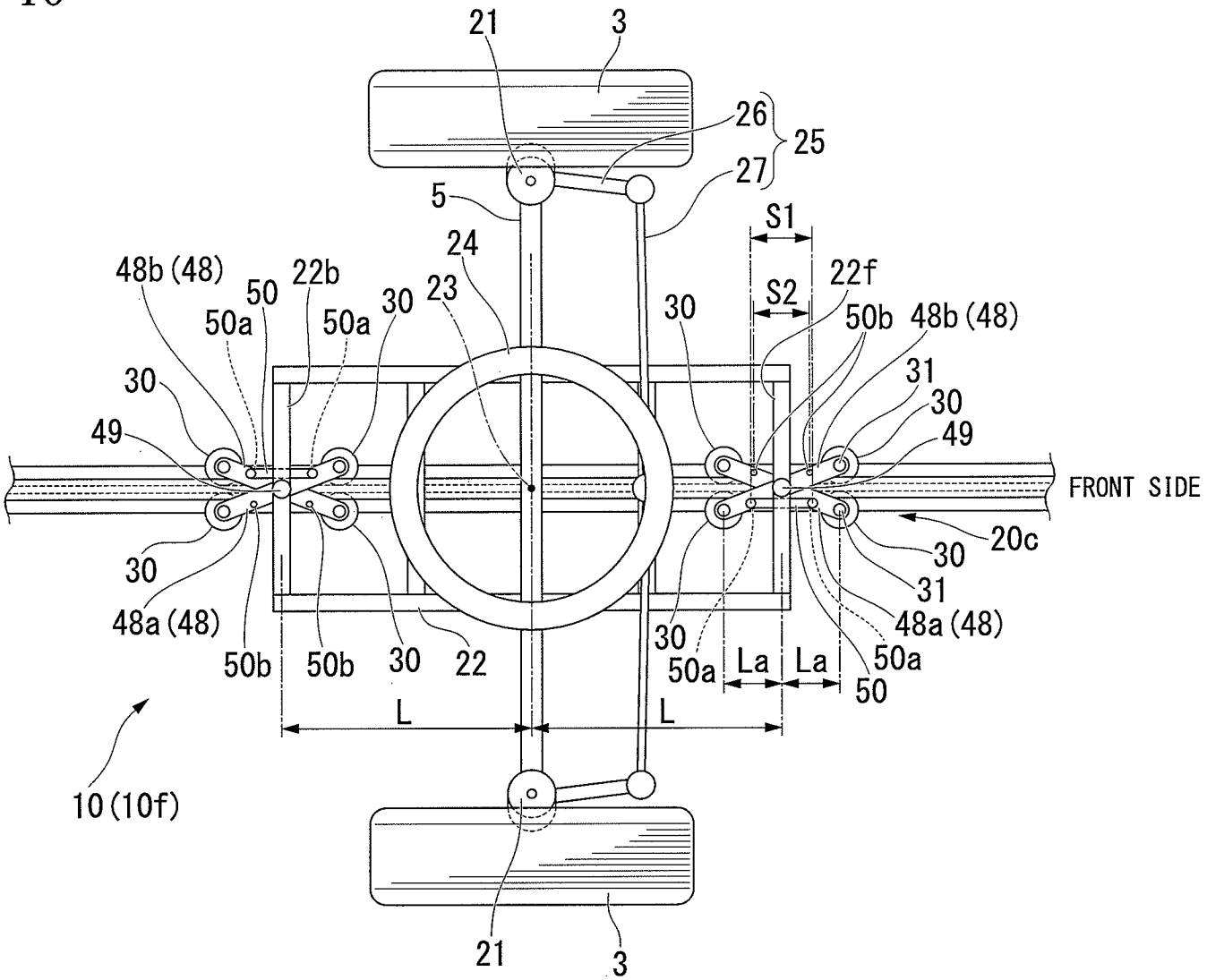
FIG. 10 is a schematic view of a running device of a guide rail type vehicle in a fourth embodiment related to the invention.

Next, a fourth embodiment of the guide rail type vehicle related to the invention will be described referring to FIG. 10.

A steering guide device 20*c* of the vehicle of the present embodiment, similarly to the steering guide devices 20 of the above respective embodiments, is provided with the kingpins 21, the guide frame 22, the rotation axis bearing 24, the guide wheels 30, equalizing links 48, and the steering link mechanism 25. Moreover, the steering guide device 20*c* of the present embodiment is provided with a clearance adjusting rod 50 that secures the interval between the two guide wheels 30 that form the gripping pair.

The number of gripping pairs each constituted by the two guide wheels 30 that grip the center guide rail 90 is four per one running device in the present embodiment, similarly to the first embodiment. Hence, in the present embodiment, one running device 10 has a total of eight guide wheels 30 (=4×2).

In the present embodiment, as the equalizing links 48, there is a first cross equalizing link 48*a* that connects two guide wheels 30 each other as the connected pair. The two guide wheels 30 are a guide wheel 30 arranged on one side in the vehicle width direction with reference to the center guide rail 90 in the two guide wheels 30 that form one gripping pair, and a guide wheel 30 arranged on the other side in the vehicle width direction in the two guide wheels 30 that form the other gripping pair that is adjacent to this one gripping pair in the front-and-rear direction. Moreover, as the equalizing links 48, there is a second cross equalizing link 48*b* that connects two guide wheels 30 each other as the connected pair. The two guide wheels 30 are the guide wheel 30 arranged on the other side in the vehicle width direction in the two guide wheels 30 that form the aforementioned one gripping pair, and the guide wheel 30 arranged on one side in the vehicle width direction in the two guide wheels 30 that form the aforementioned other gripping pair.

Hence, the running device 10 of the present embodiment having a total of eight guide wheels 30 has two first cross equalizing links 48*a* and two second cross equalizing links 48*b*, respectively, that is, a total of four cross equalizing links 48.

Each cross equalizing link 48 supports the two guide wheels 30 that form a connected pair at both ends thereof so as to be able to roll about guide wheel shafts 31 parallel to the rotation axis 23. Additionally, each cross equalizing link 48 has a central portion attached to the front beam 22*f* or the rear beam 22*b* of the guide frame 22 so as to be rotatable about a cross link shaft 49 parallel to the rotation axis 23. However, the cross link shaft 49 of the first cross equalizing link 48*a* and the cross link shaft 49 of the second cross equalizing link 48*b* are the same shaft, and the respective cross equalizing links 48*a* and 48*b* share the cross link shaft 49 mutually.

The interval La from the cross link shaft 49 of each cross equalizing link 48 to the guide wheel shaft 31 of one guide wheel 30 connected by this cross equalizing link 48 is the same as the interval La from this cross link to the guide wheel shaft 31 of the other guide wheel 30.

The portion of the first cross equalizing link 48*a* on one side in the vehicle width direction with reference to the center guide rail 90, and the portion of the second cross equalizing link 48*b* on one side in the vehicle width direction with reference to the center guide rail 90 are connected by the aforementioned clearance adjusting rod 50 to secure the interval between the two guide wheels 30 that form the gripping pair.

Through holes 50*a* are respectively formed in the portions of the first cross equalizing link 48*a* and the second cross equalizing link 48*b* that are connected with the clearance adjusting rod 50. The first cross equalizing link 48 and the second cross equalizing link 48 are pin-coupled with the clearance adjusting rod 50 by pins insertion through the through holes 50*a*.

As described above, in the present embodiment, the number of the guide wheels 30 provided in one running device 10 is eight similarly to the first embodiment. Therefore, the load per one guide wheel can be mitigated. For this reason, also in the present embodiment, similarly to the first embodiment, the width and external diameter of the guide wheels 30 can be made small while maintaining the durability of the guide wheels 30.

Additionally, also in the present embodiment, when the guide wheels 30 reach a stepped portion, such as a joint of the center guide rail 90, the lateral loads that the two guide wheels 30 that form a connected pair receive, respectively, are equalized by the cross equalizing links 48. Thus, deterioration of ride quality can be prevented.

Additionally, in the present embodiment, the guide wheels 30 supported by the cross equalizing links 48 can be easily separated from the center guide rail 90 by removing the clearance adjusting rod 50. For this reason, operations, such safety check or replacement of the guide wheels 30 can be easily performed.

Incidentally, in a case where the two guide wheels 30 on one side in the vehicle width direction with reference to the center guide rail 90 are adopted as the connected pair as in the embodiment described earlier, as described referring to FIG. 6, the clearance adjustor 43 that moves the link shaft 41 that is the center of rotation of the equalizing link 40 in the vehicle width direction is provided in order to cope with wear of the outer peripheries of the guide wheels 30. However, in a case where one guide wheel 30 on one side in the vehicle width direction with reference to the center guide rail 90 and one guide wheel 30 on the other side are adopted as the connected pair as in the present embodiment, if the cross link shaft 49 of the cross equalizing link 48 that connects this connected pair is moved in the vehicle width direction, the other guide wheel 30 will be kept away from the center guide rail 90 even if one guide wheel 30 of the two guide wheels 30 that form the connected pair approaches the center guide rail 90. For this reason, it is not possible to cope with wear of the guide wheels 30 in the movement of the cross link shaft 49 of the cross equalizing link 48.

Thus, in the present embodiment, in order to cope with the wear of the guide wheels 30, as through holes where the clearance adjusting rod 50 pin-couples the first cross equalizing link 48*a* and the second cross equalizing link 48*b*, through-holes 50*b* used where the guide wheels are wear other than the through-holes 50*a* for initial-setting are formed in the first cross equalizing link 48*a* and the second cross equalizing link 48*b*.

The distance S2 from the through-hole 50*b* formed in the first cross equalizing link 48*a* via the cross link shaft 49 to the through-hole 50*b* formed in the second cross equalizing link 48*b* is shorter than the distance S1 from the through-hole 50*a* formed in the first cross equalizing link 48*a* via the cross link shaft 49 to the through-hole 50*a* formed in the second cross equalizing link 48*b*. For this reason, if the guide wheels 30 are worn out, the interval between the two guide wheels 30 that form the gripping pair can be made small by inserting pins into the through-holes 50*b* and pin-coupling the first cross equalizing link 48*a* and the second cross equalizing link 48*b* with the clearance adjusting rod 50 using these pins.

In addition, in order to cope with the wear of the guide wheels 30, the positions where the clearance adjusting rod 50 pin-couples the first cross equalizing link 48*a* and the second cross equalizing link 48*b* are changed. However, even if the length of the clearance adjusting rod 50 is changed, the interval between the two guide wheels 30 that form the gripping pair can be changed. Thus, a clearance adjusting rod 50 of which the length is greater than the length of an original clearance adjusting rod 50 may be separately prepared for a case of the wear of the guide wheels 30, and this clearance adjusting rod 50 for a case of wear may be used at the time of the wear of the guide wheels 30. Additionally, the wear of the guide wheels 30 may be coped with by increasing the length of the clearance adjusting rod using the clearance adjusting rod that can change its length.

Figure 11:
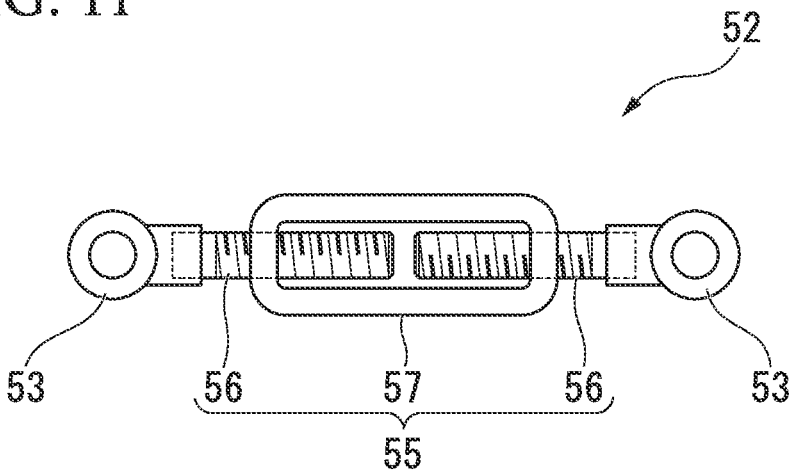
FIG. 11 is a side view of a first modification of a clearance adjusting rod in the fourth embodiment related to the invention.

As the clearance adjusting rod into that can change its length, for example, a clearance adjusting rod 52 as shown in FIG. 11 may be considered. The clearance adjusting rod 52 has two eyelets 53 that are pin-coupled with the cross equalizing links 48, and a length adjusting tool (clearance adjustor) 55 that is provided between the two eyelets 53. The length adjusting tool 55 has male threads 56 that extend from the respective eyelets 53, and a trunk portion 57 that is formed with a female thread to which the respective male threads 56 are screwed. The respective male threads 56 are screwed to the trunk portion 57 so that the longitudinal direction thereof is located on the same straight line. One female thread of the trunk portion 57 is a right screw, and the other female thread is a left screw. For this reason, if the trunk portion 57 is rotated relative to the respective male threads 56, the relative interval between one male thread 56 and the other male thread 56 changes, and the overall length of the clearance adjusting rod 52 changes.

Figure 12:
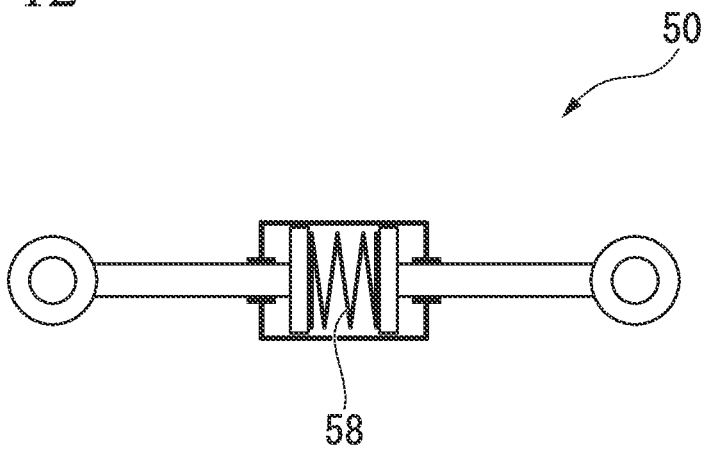
FIG. 12 is a side view of a second modification of the clearance adjusting rod in the fourth embodiment related to the invention.

Additionally, it is preferable that the clearance adjusting rod 50, as shown in FIG. 12, have a resilient body 58 that is resiliently deformed in the longitudinal direction. As the resilient body 58, for example, a coil spring is considered. This is because when the guide wheels 30 have reached the stepped portion of the center guide rail 90, the resilient body 58 can be resiliently deformed to change the mutual interval between the two guide wheels 30 that form the gripping pair to absorb the shocking lateral loads that the guide wheels 30 receive.

As methods of absorbing the shocking lateral loads that the guide wheels 30 receive, a method of using the cross equalizing links 48 that have a resilient body that is resiliently deformed in a direction in which the two guide wheels 30 that form the gripping pair are arranged is also considered in addition to the method using the clearance adjusting rod 50 that has the resilient body 58. In this case, at least portions of the cross equalizing links 48 are formed from, for example, a flat-spring material. Moreover, a method of providing a resilient body (rotation suppressor) that suppresses the rotation of the cross equalizing links 48 about the cross link shaft 49 is also considered. In this case, one end of the resilient body is attached to the cross equalizing link 48, and the other end thereof is attached to the guide frame 22.

In addition, as for the equalizing links 40, the W equalizing links 40, the LL equalizing links 44, and the LW equalizing links 46 in the above embodiments, in order to absorb the shocking lateral loads that the guide wheels 30 receive, similarly to the cross equalizing links 48, at least a part thereof may be formed from, for example, flat-spring material so that the links are resiliently deformed in the direction in which the two guide wheels 30 that form the gripping pair are arranged. Additionally, as for the equalizing links 40, the W equalizing links 40, the LL equalizing links 44, and the LW equalizing links 46, a resilient body (rotation suppressor) that suppresses the rotation of these links about link shafts may be provided.

Fifth Embodiment

Next, a fifth embodiment of the guide rail type vehicle related to the invention will be described referring to FIGS. 13 to 15.

Figure 13:
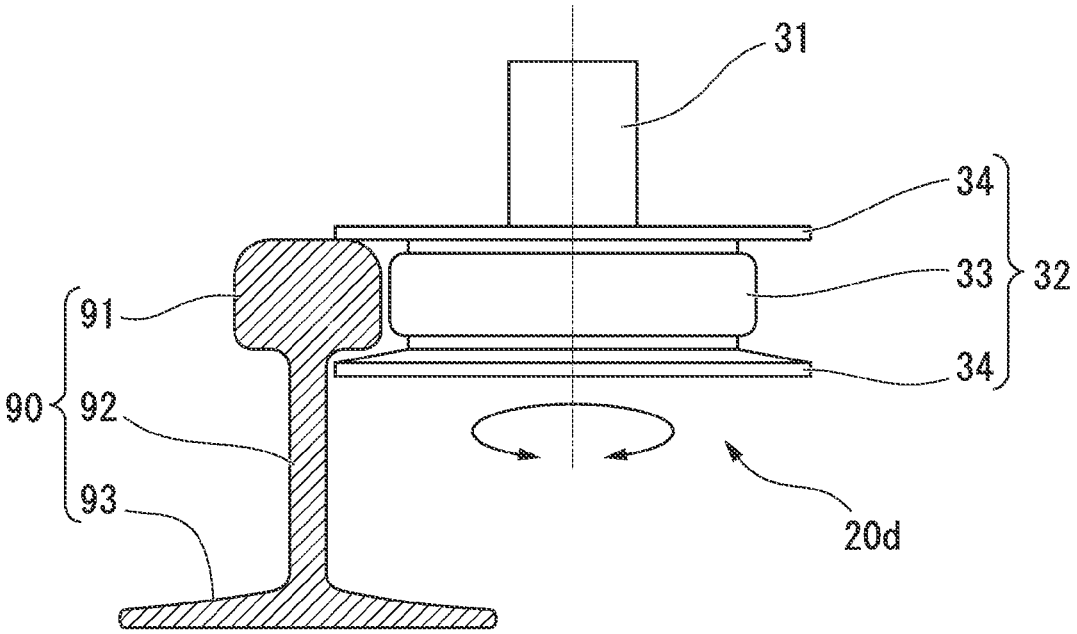
FIG. 13 is a front view of guide wheels in the fifth embodiment related to the invention.

A steering guide device 20*d* of the vehicle of the present embodiment is a modification of the first embodiment in which a guide wheel 32 with flanges is adopted as a guide wheel, as shown in FIG. 13.

The guide wheel 32 with flanges has a columnar main body 33 having the guide wheel shaft 31 as a center, and flanges 34 that are arranged on both sides in the direction in which the guide wheel shaft 31 extends with reference to the main body 33, and that have a greater external diameter than the external diameter of the main body 33. At least the portion of the main body 33 including the outer peripheral surface thereof is formed from resilient bodies, such as urethane rubber.

The center guide rail 90 of the present embodiment is also a railroad rail similarly to the center guide rail 90 of the above embodiments. The mutual interval between the two flanges 34 of the guide wheels 32 with flanges is almost equal to the height of a head portion 91 of the railroad rail 90 in the up-and-down direction, the lower face of the upper flange 34 faces the upper face of a head portion 91, and the upper face of the lower flange 34 faces the lower face of the head portion 91. Additionally, the lateral face of the main body 33 between the two flanges 34 faces the lateral face of the head portion 91.

In this way, in the present embodiment, the head portion 91 of the railroad rail 90 is gripped from the up-and-down direction by the two flanges 34. Therefore, the guide wheel 32 with flanges can hardly move up and down relative to the railroad rail 90. On the other hand, since the guide frame 22 to which the guide wheel 32 with flanges is attached is provided in the truck frame 12 provided via the rotation axis bearing 24 so as to be movable up and down with respect to the vehicle body 1 (FIG. 1), the guide frame moves up and down relative to the railroad rail 90. For this reason, the present embodiment is provided with a link supporting mechanism in which the guide wheel 32 with flanges is movable up and down relative to the guide frame 22.

Figure 14:
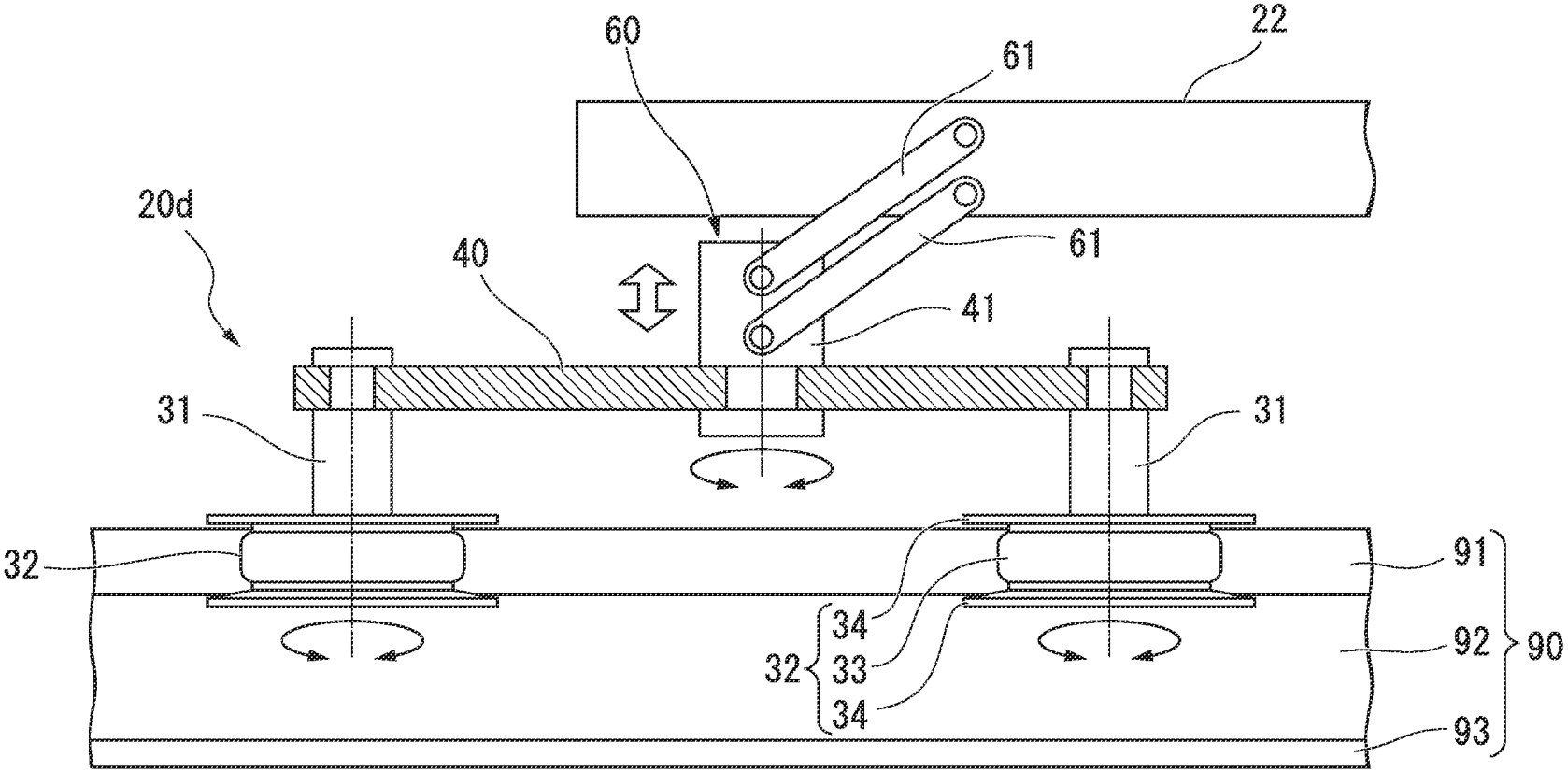
FIG. 14 is a side view of the guide wheels and a link supporting mechanism in the fifth embodiment related to the invention.

The link supporting mechanism 60 has, for example, two links 61 that connect the link shaft 41 of the equalizing link 40 and the guide frame 22 and are parallel to each other, as shown in FIG. 14. In both the two links 61, one end portion is pin-coupled with the link shaft 41, and the other end is pin-coupled with the guide frame 22. By connecting the link shaft 41 and the guide frame 22 of the equalizing link 40 using the two links 61 that are parallel to each other, the equalizing link 40 and the guide wheel 32 with flanges supported by this equalizing link 40 can be supported so as to be movable up and down with respect to the guide frame 22, without changing the orientation of the link shaft 41.

Figure 15:
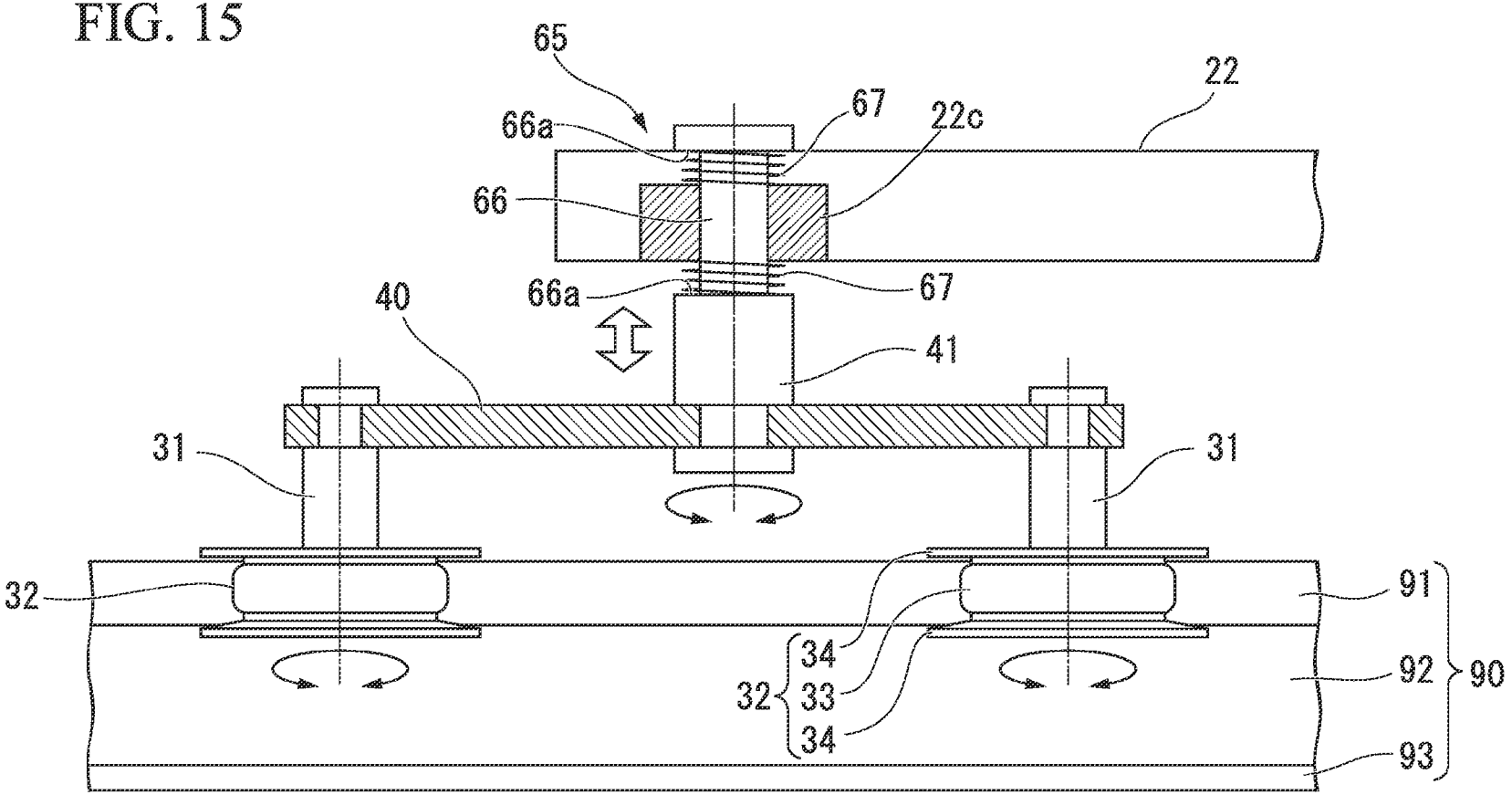
FIG. 15 is a side view of the guide wheels and another link supporting mechanism in the fifth embodiment related to the invention.

Additionally, as the link supporting mechanism, for example, a mechanism as shown in FIG. 15 may also be considered. The link supporting mechanism 65 has an attachment shaft 66 that is coaxial with the link shaft 41 of the equalizing link 40, and a spring 67 that is disposed around the attachment shaft 66. The attachment shaft 66 is provided at an end portion of the link shaft 41. Both axial ends of the attachment shaft 66 are formed with collar portions 66*a*. The attachment shaft 66 is inserted through an insertion hole of a bracket 22*c* fixed to the guide frame 22. The aforementioned springs 67 are arranged between one collar portion 66*a* of the attachment shaft 66 and the brackets 22*c* and between the other collar portion 66*a* of the attachment shaft 66 and the bracket 22*c*, respectively. In addition, the link shaft 41 and the attachment shaft 66 are basically an integrally molded article.

As described above, the link supporting mechanism 65 can also support the equalizing link 40 and the guide wheels 32 with flanges supported by this equalizing link 40 so as to be movable up and down with respect to the guide frame 22.

In addition, although the present embodiment is a modification of the first embodiment as mentioned above, it is needless to say that the second to fourth embodiments may be similarly modified. In this case, it is preferable to provide the LL equalizing link 44 with the link supporting mechanism in the second embodiment, to provide the LW equalizing link 46 with the link supporting mechanism in the third embodiment, to provide the cross equalizing link 48 with the link supporting mechanism in the fourth embodiment.

REFERENCE SIGNS LIST

1: VEHICLE BODY
2: UNDERFRAME
3: TIRE
5: AXLE
10, 10*f*, 10*b*: RUNNING DEVICE
11: SUSPENSION SYSTEM
12: TRUCK FRAME
19: AIR SPRING
20, 20*a*, 20*b*, 20*c*, 20*d*: STEERING GUIDE DEVICE
21: KINGPIN
22: GUIDE FRAME
23: ROTATION AXIS
24: ROTATION AXIS BEARING
25: STEERING LINK MECHANISM
30: GUIDE WHEEL
31: GUIDE WHEEL SHAFT
32: GUIDE WHEEL WITH FLANGE
40: EQUALIZING LINK (W EQUALIZING LINK)
41: LINK SHAFT
43: CLEARANCE ADJUSTOR
44: LL EQUALIZING LINK
45: LL LINK SHAFT
46: LW EQUALIZING LINK
47: LW LINK SHAFT
48, 48*a*, 48*b*: CROSS EQUALIZING LINK
49: CROSS LINK SHAFT
50, 52: CLEARANCE ADJUSTING ROD
55: LENGTH ADJUSTING TOOL
60, 65: LINK SUPPORTING MECHANISM
90: CENTER GUIDE RAIL (RAILROAD RAIL)

The invention claimed is:

1. A guide rail vehicle that travels along a center guide rail comprising:

a guide frame provided so as to be rotatable about a rotation axis perpendicular to a floor surface of a vehicle body;

a plurality of guide wheels which forms gripping pairs aligned in the vehicle width direction so as to be able to grip the center guide rail, and which is arranged in the front-and-rear direction of the guide frame;

an equalizing link supporting one guide wheel of the plurality of guide wheels and another guide wheel located on the front or rear side of the guide frame with respect to the one guide wheel so as to be able to roll about a guide wheel shaft parallel to the rotation axis, the equalizing link connecting the one guide wheel and the other guide wheel as a connected pair and being attached to the guide frame so as to be rotatable about a link shaft parallel to the rotation axis; and a steering link mechanism changing the steering angle of wheels in association with the rotation of the guide frame about the rotation axis, wherein the equalizing link is a link that connects the two guide wheels each other as the connected pair, the two guide wheels being adjacent to each other in the front-and-rear direction on one side in the vehicle width direction with reference to the center guide rail, and an interval between the link shaft of the equalizing link that connects the two guide wheels that form the connected pair and the guide wheel shaft of the guide wheel of the two guide wheels, which is far from the rotation axis, is greater than the interval between the link shaft and the guide wheel shaft of the guide wheel near to the rotation axis.

2. The guide rail vehicle according to claim 1, wherein the plurality of guide wheels that form the three or more gripping pairs is arranged outside the vehicle body in the front-and-rear direction with reference to the rotation axis of the guide frame, and wherein the guide rail type vehicle comprises:

a W equalizing link as the equalizing link that connects, the two guide wheels each other as the connected pair, the two guide wheels being located on the outermost side among the plurality of guide wheels arranged outside the vehicle body in the front-and-rear direction and are adjacent to each other in the front-and-rear direction; and an LW equalizing link that supports the guide wheel, which is arranged closer to the central side of the vehicle body in the front-and-rear direction than the two guide wheels connected by the W equalizing link, among the plurality of guide wheels arranged outside the vehicle body, so as to be able to roll about the guide wheel shaft of the guide wheel, and that supports the W equalizing link so as to be rotatable about the link shaft of the W equalizing link, connects the guide wheels and the W equalizing link to each other, and is attached to the guide frame so as to be rotatable around an LW link shaft parallel to the rotation axis.

3. The guide rail vehicle according to claim 2, wherein the plurality of guide wheels that form the two or more gripping pairs is arranged on the central side of the vehicle body in the front-and-rear direction with reference to the rotation axis of the guide frame, and wherein the plurality of guide wheels that is arranged on the central side of the vehicle body forms one of the connected pair respectively, and is connected to each other by the equalizing link.

4. The guide rail vehicle according to claim 1, comprising:

a first W equalizing link as the equalizing link that connects the two guide wheels that form the connected pair;

a second W equalizing link as the equalizing link that connects the two guide wheels that form the connected pair arranged in the front-and-rear direction with respect to the first W equalizing link; and an LL equalizing link that supports the first W equalizing link so as to be rotatable about the link shaft of the first W equalizing link and that supports the second W equalizing link so as to be rotatable about the link shaft of the second W equalizing link, connects the first W equalizing link and the second W equalizing link, and is attached to the guide frame so as to be rotatable around an LL link shaft parallel to the rotation axis.

5. The guide rail vehicle according to claim 1, further comprising a clearance adjustor that adjusts the interval between the two guide wheels that form the gripping pair.

6. The guide rail vehicle according to claim 1, wherein a plurality of the connected pairs is arranged in the front-and-rear direction.

7. The guide rail vehicle according to claim 1, wherein the equalizing link has a resilient body that is resiliently deformed in a direction in which the two guide wheels that form the gripping pair are arranged.

8. The guide rail vehicle according to claim 1, further comprising a rotation suppressor that suppresses the rotation of the equalizing link about the link shaft.

9. The guide rail vehicle according to claim 1, wherein the guide wheel has a main body of which the peripheral surface is formed with the guide wheel shaft as a center, and flanges that are arranged on both sides in the direction in which the guide wheel shaft extends with reference to the main body, and that have a greater external diameter than the external diameter of the main body.

10. The guide rail vehicle according to claim 9, wherein the link shaft is provided so as to be movable in the direction in which the link shaft extends with respect to the guide frame.

* * * * *